US006746101B2

(12) United States Patent
Otsuki

(10) Patent No.: US 6,746,101 B2
(45) Date of Patent: Jun. 8, 2004

(54) PRINTING UP TO EDGES OF PRINTING PAPER WITHOUT PLATEN SOILING

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/965,678

(22) Filed: Sep. 26, 2001

(65) Prior Publication Data

US 2002/0130910 A1 Sep. 19, 2002

(30) Foreign Application Priority Data

Sep. 27, 2000 (JP) ..... 2000-294250
Sep. 27, 2000 (JP) ..... 2000-294293

(51) Int. Cl.[7] ..... B41J 23/00; B41J 29/38
(52) U.S. Cl. ..... 347/37; 347/14
(58) Field of Search ..... 347/37, 36, 75, 347/14; 358/1.14, 1.16

(56) References Cited

U.S. PATENT DOCUMENTS 4,198,642 A 4/1980 Gamblin ..... 347/41
4,207,578 A * 6/1980 Marinoff ..... 347/35
5,958,552 A * 9/1999 Fukuda et al. ..... 428/141
6,166,827 A * 12/2000 Campbell et al. ..... 358/1.17
6,239,817 B1 * 5/2001 Meyer ..... 347/36
6,359,701 B1 * 3/2002 Yamada et al. ..... 358/1.2

FOREIGN PATENT DOCUMENTS

JP 08/169155 7/1996
JP 11-245937 9/1999
JP 2000118058 A 4/2000 ..... B41J/11/02
JP 2000351205 A 12/2000 ..... B41J/2/01

* cited by examiner

*Primary Examiner*—Stephen D. Meier
*Assistant Examiner*—Alfred Dudding
(74) *Attorney, Agent, or Firm*—Beyer Weaver & Thomas

(57) ABSTRACT

Images are printed up to the edges of printing paper while preventing ink droplets from depositing on the platen. According to the present invention, an area R for ejecting image-forming ink droplets is specified for a region lying beyond the edges of a printing paper P. The pixels of an external upper edge portion Rfp, extending beyond the upper edge Pf, and the pixels of an internal upper edge portion Rfq, disposed downstream of the external upper edge portion Rfp are recorded solely by the nozzles disposed opposite the downstream slot of the platen. When dots are recorded, blank spaces are prevented from forming in the edge portions of the printing paper, and ink droplets are prevented from depositing on the platen when the printing paper P deviates from its intended position.

42 Claims, 24 Drawing Sheets

Fig.8

| Material : P1 | Lfp | Lfq | Lrp | Lrq | Wa,Wb |
|---|---|---|---|---|---|
| Postcard | 1.5 | 1.5 | 2.0 | 1.5 | 1.5 |
| A4 | 3.0 | 3.0 | 3.8 | 3.0 | 3.0 |
| A3 | 4.5 | 4.5 | 5.5 | 4.5 | 4.5 |

| Material : P2 | Lfp | Lfq | Lrp | Lrq | Wa,Wb |
|---|---|---|---|---|---|

| Material : P3 | Lfp | Lfq | Lrp | Lrq | Wa,Wb |
|---|---|---|---|---|---|

[mm]

Fig.9A

| P1/720dpi | Rfp | Rfq | Rrp | Rrq | Wa,Wb |
|---|---|---|---|---|---|
| Postcard | 43 | 43 | 57 | 43 | 43 |
| A4 | 85 | 85 | 108 | 85 | 85 |
| A3 | 128 | 128 | 156 | 128 | 128 |

[Number of raster lines, number of pixels]

Fig.9B

| P1/1440dpi | Rfp | Rfq | Rrp | Rrq | Wa,Wb |
|---|---|---|---|---|---|
| Postcard | 85 | 85 | 113 | 85 | 85 |
| A4 | 170 | 170 | 215 | 170 | 170 |
| A3 | 255 | 255 | 312 | 255 | 255 |

[Number of raster lines, number of pixels]

PRINTING UP TO EDGES OF PRINTING PAPER WITHOUT PLATEN SOILING

BACKGROUND OF THE INVENTION

1. Field of the Invention

The present invention relates to a technique for recording dots on the surface of a recording medium with the aid of a dot-recording head, and more particularly to a technique for printing images up to the edges of printing paper without soiling the platen.

2. Description of the Related Art

Printers in which ink is ejected from the nozzles of a print head have recently become popular as computer output devices. FIG. 24 is a side view depicting the periphery of a print head for a conventional printer. Printing paper P is supported on a platen 26*o* while facing the head 28*o*. The printing paper P is fed in the direction of arrow A by the upstream paper feed rollers 25*p* and 25*q* disposed upstream of the platen 26*o* and by the downstream paper peed rollers 25*r* and 25*s* disposed downstream of the platen 26*o*. Dots are recorded and images printed on the printing paper P when ink is ejected from the head.

SUMMARY OF THE INVENTION

When an attempt is made to print images without blank spaces up to the edges of printing paper with the aid of such a printer, it is necessary to arrange the printing paper such that the edges of the printing paper are disposed underneath the print head (that is, on the platen) and to cause ink droplets to be ejected from the print head when print data are specified for the areas that extend up to the edges of the printing paper and printing is carried out. With such printing, however, blank spaces form in the edge portions of the printing paper due to errors developing during the feeding of the printing paper, a shift in the impact location of the ink droplets, or the like. In addition, the ink droplets sometimes miss the edges of the printing paper (for which the droplets have been originally intended) and end up depositing on the platen due to errors developing during the feeding of the printing paper, a shift in the impact location of the ink droplets, or the like. In such cases, the ink deposited on the platen soils the printing paper transported over the platen in the next step.

It is an object of the present invention, which was perfected in order to overcome the above-described shortcomings of the prior art, to provide a technique that allows images to be printed up to the edges of printing paper while preventing ink droplets from depositing on the platen.

Perfected in order to at least partially overcome the above-described shortcomings, the present invention envisages performing specific procedures for a dot-recording device designed to record dots on the surface of a print medium with the aid of a dot-recording head provided with a plurality of dot-forming elements for ejecting ink droplets. This dot-recording device comprising a main scanning unit configured to drive the dot-recording head and/or the print medium to perform main scanning, a head driver configured to drive at least some of the dot-forming elements to form dots during the main scanning, a platen configured to extend in the main scanning direction and to be disposed opposite the dot-forming elements at least along part of a main scan path, a sub-scanning unit configured to move the print medium to perform sub-scanning in between the main scans, and a controller configured to control the dot-recording device.

The platen has a slot configured to extend in the main scanning direction, a width of the slot in the sub-scanning direction corresponding to a specific sub-scanning range on a surface of the dot recording head including at least part of the plurality of dot-forming elements.

In the printing, an expanded area is set in accordance with a type of print medium to be used in the dot recording, the expanded area extending lengthwise beyond at least front and rear edges of the print medium, and representing a recording area in which images are to be recorded on the print medium. Print data for recording images in the expanded area is prepared. Then edge printing is performed by ejecting ink droplets from at least some of the dot-forming elements disposed opposite the slot when images are printed at least in front- or rear-edge portions of the print medium on the basis of the print data.

With this arrangement, ink droplets can be prevented from depositing on the platen, and images can be printed without blank spaces up to the front and rear edge of the print medium. Selecting the correct size for the expanded area in accordance with the type of print medium makes it possible to prevent situations in which time is wasted when images are printed by ejecting ink droplets over an area that is unnecessarily wide for a given size of print medium.

The type of print medium preferably depends on dimensions of the print medium. When a print medium tilts away from its intended orientation, the extent to which the edge portions of the print medium are shifted increases with the dimensions of the print medium. Consequently, selecting an expanded area in accordance with a category related to the dimensions of the print medium makes it possible to establish the expanded area in an appropriate manner such that ink droplets are prevented from depositing on the platen, and images are printed without blank spaces up to the edges of the printing paper.

The type of print medium should preferably be set in accordance with the material of the print medium. The feed error occurring during the sub-scanning of a print medium sometimes varies with the type of print medium. Consequently, selecting an expanded area in accordance with a category related to the material of the print medium makes it possible to establish the expanded area in an appropriate manner such that ink droplets are prevented from depositing on the platen, and images are printed without blank spaces up to the edges of the printing paper.

The following procedure should preferably be adopted when ink droplets are ejected onto an expanded area. When ink droplets are ejected onto the front edge of the print medium, the position of the print medium in the sub-scanning direction is set such that the print medium is supported on the platen, the front edge of the print medium is brought to a point above the slot, and the front edge of the print medium reaches a point located in the sub-scanning direction upstream of a dot-forming element at a downstream end in the sub-scanning direction. When ink droplets are ejected onto the rear edge of the print medium, the position of the print medium in the sub-scanning direction is set such that the print medium is supported on the platen, the rear edge of the print medium is brought to a point above the slot, and the rear edge of the print medium reaches a point located in the sub-scanning direction downstream of a dot-forming element at an upstream end in the sub-scanning direction. With this arrangement, ink droplets can be prevented from depositing on the platen, and images can be printed without blank spaces up to the front and rear edge of the print medium.

The following procedure should preferably be adopted during the preparation of print data when the platen has a pair of lateral slots that are separated apart at a distance substantially equal to the width of the print medium, and the lateral slots extend in a sub-scanning range in which ink droplets are ejected from the plurality of dot-forming elements. The print data for recording images in an expanded area is prepared. The expanded area extends widthwise beyond left and right edges of the print medium but remaining between farthermost side walls of the pair of lateral slots. With this arrangement, it is possible to prepare print data whereby ink droplets can be prevented from depositing on the platen, and images can be printed without blank spaces up to the left and right edges of the print medium.

The following procedure should preferably be adopted when ink droplets are ejected onto the expanded area. The position of the print medium in the main scanning direction is set such that the print medium is supported on the platen, and the left and right edges of the print medium are brought to a point above the lateral slots. Dots are formed on the basis of image data representing an image extending outside the print medium beyond the left and right edges. With this arrangement, ink droplets can be prevented from depositing on the platen, and images can be printed without blank spaces up to the left and right edges of the print medium.

Print data should preferably be prepared such that these data contains information about recording condition of dots at pixels inside the expanded area. Such an embodiment makes it easier to set up portions of the expanded area beyond the edges of a print medium.

A dot-recording control device comprising a image data generator, an area size memory, an input unit, and a print data generator is provided as an embodiment of the present invention. The image data generator generates image data for the images recorded on the print medium. In the area size memory, information about an expanded area that extends in terms of length beyond at least the front and rear edge of the print medium and represents a recording area in which images are to be recorded on the print medium is stored for each type of print medium. The input unit is used to enter information about the types of print medium. In the print data generator, the print data for recording dots with which images can be formed in an expanded area are generated on the basis of information about the selected type of print medium, information about the expanded area, and image data.

This arrangement allows print data to be generated such that ink droplets can be prevented from depositing on the platen, and images can be printed without blank spaces up to the edges of the printing paper. Selecting the correct size for the expanded area in accordance with the type of print medium makes it possible to generate print data such that situations are prevented in which time is wasted when images are printed by ejecting ink droplets over an area that is unnecessarily wide for a given size of print medium.

The following procedure should preferably be adopted when the expanded area is divided, in order from the top, into an external front edge portion disposed in an area beyond the front edge of the print medium and configured such that formation of dots in this portion is assigned to the dot-forming elements disposed opposite the slot; an internal front edge portion on the front-edge portion of the print medium and configured such that formation of dots in this portion is assigned to the dot-forming elements disposed opposite the slot; an intermediate portion of the print medium; an internal rear edge portion on the rear-edge portion of the print medium and configured such that formation of dots in this portion is assigned to the dot-forming elements disposed opposite the slot; and an external rear edge portion disposed in an area beyond the rear edge of the print medium and configured such that formation of dots in this portion is assigned to the dot-forming elements disposed opposite the slot. Specifically, the area size memory substantially contains the dimensions of the external front edge portion in the sub-scanning direction, the dimensions of the internal front edge portion in the sub-scanning direction, the dimensions of the internal rear edge portion in the sub-scanning direction, and the dimensions of the external rear edge portion in the sub-scanning direction.

With this arrangement, the position of the expanded area in relation to the print medium can be defined in an appropriate manner. Ejecting ink droplets onto the external front edge portion, internal front edge portion, internal rear edge portion, and external rear edge portion of the expanded area makes it possible to print images on the edge portions of the print medium without forming blank spaces along the edges of the printing paper or depositing the ink droplets on the platen.

In the printing, following procedures are preferable. A specific print mode is selected from among a plurality of print modes. The print data for recording images in an expanded area is prepared. The expanded area extends lengthwise beyond the front and rear edges of the print medium in accordance with he selected print mode. Then ink droplets are ejected from at least some of the dot-forming elements disposed opposite the slot when images are printed in the front- and rear-edge portions of the print medium on the basis of the print data.

Such an embodiment allows expanded areas suited to individual print modes to be prepared and dots to be formed such that images are printed in an appropriate manner without blank spaces in the edge portions of the print medium.

When the plurality of print modes includes print modes with mutually different recording densities for the raster lines in the sub-scanning direction, a number of raster lines constituting the expanded area should preferably be established in accordance with the selected print mode when print data are prepared. With this arrangement, the size of the expanded area in the sub-scanning direction can be defined in accordance with the print mode by adopting the concept of "raster line" for the printing device during actual printing.

Images should preferably be printed using solely the dot-forming elements disposed opposite the slot during printing in the front- and rear-edge portions of the print medium. Adopting this embodiment prevents the platen from being soiled when the front or rear edge shifts away from the slot during printing in the front- or rear-edge portion of the print medium.

The expanded area may be divided, in order from the top, into an external front edge portion, an intermediate portion, an internal front edge portion, an internal rear edge portion, an external rear edge portion. The external front edge portion is disposed in an area beyond the front edge of the print medium and configured such that formation of dots in this portion is assigned to the dot-forming elements disposed opposite the slot. The internal front edge portion corresponds to the front-edge portion of the print medium and is configured such that formation of dots in this portion is assigned to the dot-forming elements disposed opposite the slot. The intermediate portion corresponding to an intermediate portion of the print medium. The internal rear edge portion corresponds to the rear-edge portion of the print medium and is configured such that formation of dots in this portion is assigned to the dot-forming elements disposed opposite the slot. The external rear edge portion is disposed in an area beyond the rear edge of the print medium and is configured such that formation of dots in this portion is assigned to the dot-forming elements disposed opposite the slot.

It is preferable to set a number of raster lines for the external front edge portion according to the selected print mode such that dimensions of the external front edge portion remain the same in the sub-scanning direction with respect to different print modes having mutually different sub-scan resolutions, when the same type of print medium is used. It is also preferable to set a number of raster lines for the external rear edge portion such that the dimensions of the external rear edge portion remain the same in the sub-scanning direction with respect to different print modes having mutually different sub-scan resolutions, when the same type of print medium is used.

With this arrangement, the dimensions of the external front edge portion and external rear edge portion remain substantially the same in any print mode. For this reason, the expanded area can be established such that the likelihood of blank spaces forming in the edge portions of the print medium is reduced in a way that does not change with the print mode.

It is preferable to set a number of raster lines for the internal front edge portion such that the dimensions of the internal front edge portion remain the same in the sub-scanning direction with respect to different print modes having mutually different sub-scan resolutions, when the same type of print medium is used. It is also preferable to set a number of raster lines for the internal rear edge portion such that the dimensions of the internal rear edge portion remain the same in the sub-scanning direction with respect to different print modes having mutually different sub-scan resolutions, when the same type of print medium is used.

With this arrangement, the dimensions of the internal front edge portion and internal rear edge portion remain substantially the same in any print mode. For this reason, the expanded area can be established such that the likelihood of the platen being soiled is reduced in a way that does not change with the print mode.

When ink droplets are ejected onto the front edge of the print medium, the position of the print medium in the sub-scanning direction is preferably selected such that the print medium is supported on the platen, the front edge of the print medium is brought to a point above the slot, and the front edge of the print medium reaches a point located in the sub-scanning direction upstream of the dot-forming element at a downstream ende in the sub-scanning direction. When ink droplets are ejected onto the rear edge of the print medium, the position of the print medium in the sub-scanning direction is preferably selected such that the print medium is supported on the platen, the rear edge of the print medium is brought to a point above the slot, and the rear edge of the print medium reaches a point located in the sub-scanning direction downstream of a dot-forming element at an upstream end in the sub-scanning direction. With this arrangement, ink droplets can be prevented from depositing on the platen, and images can be printed without blank spaces up to the front and rear edge of the print medium.

In the case that the plurality of print modes include print modes having mutually different recording densities for the pixels in the main scanning direction, following embodiment is preferable. The dimensions of the expanded area is set such that the expanded area extends widthwise beyond left and right edges of the print medium but remains between farthermost side walls of the pair of lateral slots, and setting the number of pixels in the main scanning direction for the raster lines constituting the expanded area is specified substantially in accordance with the print mode thus selected. With this arrangement, it is possible to prepare print data whereby ink droplets can be prevented from depositing on the platen, and images can be printed without blank spaces up to the left and right edges of the print medium.

The position of the print medium in the sub-scanning direction is preferably set such that the print medium is supported on the platen, and the left and right edges of the print medium are brought to a point above the lateral slots. It is also preferable that dots are formed on the basis of image data representing an image extending outside the print medium beyond the left and right edges. With this arrangement, ink droplets can be prevented from depositing on the platen, and images can be printed without blank spaces up to the left and right edges of the print medium.

The present invention can also be implemented as a dot-recording control device for forming print data to be sent to a dot-recording unit for recording dots on the surface of a print medium with the aid of a dot-recording head provided with a plurality of dot-forming elements for ejecting ink droplets.

The print control device comprises a user interface unit, an expanded area memory, and a print data generator. The user interface unit displays a selection screen that allows the user to select one of a plurality of preinstalled print modes on a display, and that allows the selection be entered; wherein the area size memory comprises. The expanded area memory contains, for each print mode, a number of raster lines constituting the expanded area extending lengthwise beyond the front and rear edges of the print medium. The print data generator generates the print data for recording dots with which images can be formed in the expanded area on the basis of the selected print mode, the number of raster lines stored in the expanded area memory, and the image data for the images to be recorded on the print medium. Such an embodiment allows an expanded area suited to individual print modes to be prepared and images to be printed in an appropriate manner without blank spaces in the edge portions of the print medium.

The following printing procedure may preferably be adopted when a dot-recording device is used that is designed to record dots on the surface of a print medium with the aid of a dot-recording head provided with a plurality of dot-forming elements for ejecting ink droplets. The print medium contains a usable area which is defined by a closed perforated line in the entire area of the print medium. In the printing procedure, an expanded area for image recording is set in accordance with a type of print medium. The expanded area extends beyond the ends of the usable area along the entire perimeter thereof, and print data for recording images in the expanded area are prepared. Then dots are recorded by ejecting ink droplets from at least some of the dot-forming elements to the expanded area. With this arrangement, dots are printed without any margin being left up to the edges of the usable area, which is to be split off by perforated lines.

In the printing procedure, it is preferable that the print data is prepared in accordance with the selected printing mode selected from a plurality of printing modes. With this arrangement, an appropriate extended area for each printing mode can be prepared so that printing can be carried out appropriately without leaving any margins at the periphery of the usable area.

The present invention can be implemented as the following embodiments.

(1) A dot-recording method, dot-recording control method, print control method, or printing method.

(2) A dot-recording device, dot-recording control device, print control device, or printing device.

(3) A computer program for operating the device or implementing the method.

(4) A storage medium containing computer programs for operating the device or implementing the method.

(5) A data signal carried by a carrier wave and designed to contain a computer program for operating the device or implementing the method.

These and other objects, features, aspects, and advantages of the present invention will become more apparent from the following detailed description of the preferred embodiments with the accompanying drawings.

BRIEF DESCRIPTION OF THE DRAWINGS

FIG. 8 is a diagram depicting an example of an expanded area table EAT;

FIGS. 9A and 9B are tables containing examples of the number of pixels and raster lines for the portion of an expanded area beyond the four edges of printing paper P;

DESCRIPTION OF THE PREFERRED EMBODIMENT

Embodiments of the present invention will now be described through embodiments in the following sequence.

A. Overview of Embodiments
B. First Embodiment
  B1. Device Structure
  B2. Image-recording Area
  B3. Print Routine Sequence
  B4. Dot Formation
C. Modifications
  C1. Modification 1
  C2. Modification 2
  C3. Modification 3
  C4. Modification 4
  C5. Modification 5
  C6. Modification 6
  C7. Modification 7
  C8. Modification 8
  C9. Modification 9

A. Overview of Embodiments

Figure 1B:
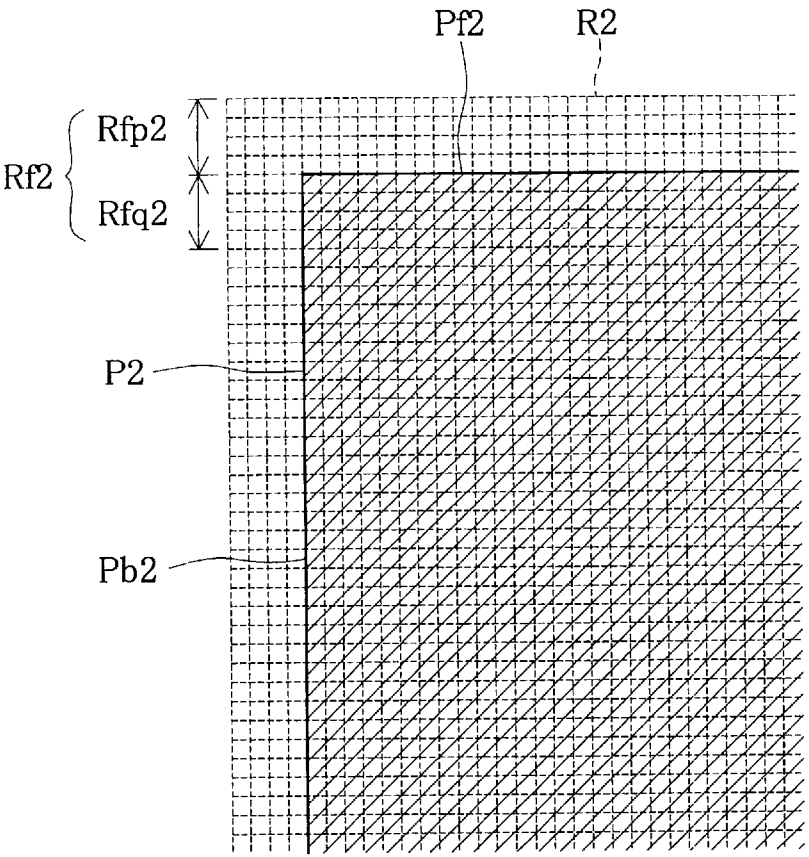
FIGS. 1A and 1B are diagrams depicting the relation between the printing paper and the area for forming images in accordance with an embodiment of the present invention.
Figure 1A:
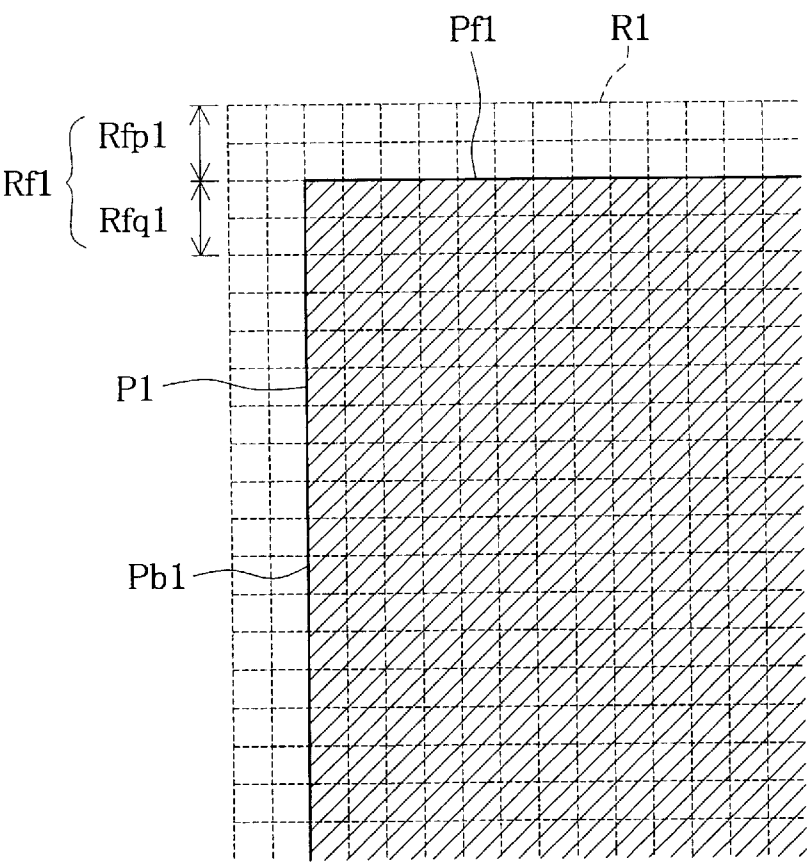

FIG. 1 is a diagram depicting the relation between the printing paper and the area for forming images in accordance with an embodiment of the present invention. FIGS. 1A and 1B each depict the upper left corner of a printing paper P. The hatched portion corresponds to printing paper P, and the portion indicated by a broken-line grid corresponds to the recording area R of an image. Each broken-line square represents a pixel. FIG. 1B depicts the relation between printing paper P and the area R for forming images when the image-recording density is twice that shown in FIG. 1A. In the present invention, the area R for ejecting ink droplets and forming images by a printer on the basis of image data is specified for a region lying beyond the edges of the printing paper P. The symbols "1" and "2" are used to distinguish between the elements of FIGS. 1A and 1B. However, the symbols "1" and "2" are omitted for common elements in FIGS. 1A and 1B.

The portion of the recording area lying outside the upper edge Pf of the printing paper P is referred to as an external upper edge portion Rfp. The pixels of the external upper edge portion Rfp are recorded solely by those nozzles of the print head that are disposed facing the downstream slot of the platen. A specific portion of the recording area R lying downstream of the external upper edge portion Rfp in the sub-scanning direction is referred to as an internal upper edge portion Rfq. The internal upper edge portion Rfq is also recorded solely by the nozzles disposed at a position opposite the downstream slot. When the printing paper P shifts from the intended position during the recording of dots on the printing paper P, it is still possible to prevent blank spaces from forming in the edge portions of printing paper, and ink droplets from depositing on the platen as long as the upper edge of the printing paper P is inside the external upper edge portion Rfp or internal upper edge portion Rfq.

Provided the dimensions and the material of the printing paper for forming images remain the same, the external upper edge portion Rfp and internal upper edge portion Rfq can be selected to have substantially the same dimensions in the sub-scanning direction even when different image-recording densities or recording systems are used. Specifically, substantially the same values are selected for the dimensions of the external upper edge portion Rfp1 in the sub-scanning direction and the dimensions of the external upper edge portion Rfp2 in the sub-scanning direction, as well as for the dimensions of the internal upper edge portion Rfr1 in the sub-scanning direction and the dimensions of the internal upper edge portion Rfr2 in the sub-scanning direction. An expanded area can thereby be established such that the same effect is achieved in reducing the likelihood that blank spaces will be formed in the edge portions of a print medium when different print modes are employed. In other words, the range within which the printing paper P can shift without causing blank space to form in the edge portions of the printing paper or ink droplets to deposit on the platen can remain constant irrespective of the image recording density or recording system.

FIGS. 2A–2F are diagrams depicting the relation between the printing paper and the area for forming images in accordance with an embodiment of the present invention. In the present invention, the area R for ejecting ink droplets and forming images by a printer on the basis of image data D is made bigger than the printing paper P. The positional relation between the printing paper P and the area R for recording images on the basis of image data is defined in the manner shown in FIGS. 2A–2F. Forming images in the area R of the printing paper P such that the area is sufficiently wide to cover the printing paper P allows images to be printed without blank spaces up to the edges of the printing paper P even when the printing paper P shifts its position somewhat. In the drawings, the recording area R is labeled as R1–R6, and the printing paper P as P1–P6.

Images are recorded in the front-edge portion Rf and rear-edge portion Rr of the recording area R solely by the nozzles disposed opposite the slot in the platen. For this reason, the ink droplets designed to record images on the edge portions are prevented from soiling the platen when the printing paper P fails to reach its intended position due to an error affecting the feeding of the printing paper P in the sub-scanning direction, a tilt of the printing paper P away from the intended orientation, or the like. In the drawings, the front-edge portion Rf of the recording area R is labeled as Rf1–Rf6, and the rear-edge portion Rr as Rr1–Rr6.

In the present invention, the recording area R of image data is specified in accordance with the type of printing paper P. The printing paper P4 shown in FIG. 2D is larger than the printing paper P1 shown in FIG. 2A. The recording area R4 corresponding to the image data compiled in order to record images on the printing paper P4 will therefore exceed in size the recording area R1 for the image data needed to record images on the printing paper P1. Shifting usually increases with an increase in the length of the printing paper P along one of its sides when the four edges of the printing paper shift their position in the directions of main scanning and sub-scanning as a result of a tilt in the orientation of the printing paper P, but specifying the recording area in this manner makes it less likely that blank spaces will form along the edges of the printing paper. A narrow recording area R1 is assigned to the printing paper P1 (which is smaller in size than the printing paper P4), preventing situations in which time is wasted during printing by recording images in a recording area with an unnecessarily large amount of image data.

The printing paper P1, P2, and P3 have the same size but are made of different materials, and the ease with which they the paper slides during sub-scanning increases in the sequence P1, P2, P3. The length (in the sub-scanning direction) of the area R for recording images on each type of printing paper increases in the sequence R1, R2, R3. More specifically, the length of the portion of the expanded area R in the sub-scanning direction between the front-edge portion Rf and rear-edge portion Rr in which images can be recorded above the slot increases in the sequence R1, R2, R3. It is therefore unlikely that blank spaces will form along the edges of the printing paper or that ink droplets will deposit on the platen when slippery printing paper slips over a comparatively long distance during sub-scanning. Similarly, the printing paper P4, P5, and P6 have the same size but increase their slipperiness in the sub-scanning direction in the sequence P4, P5, P6, so the length of the portion of the recording area R between the front-edge portion Rf and rear-edge portion Rr increases in the sequence R4, R5, R6. In the present specification, the terms "upper edge (portion)" and "lower edge (portion)" may be used to designate the edges of the printing paper P corresponding to the top and bottom of the image data recorded on the printing paper P, and the terms "front edge (portion)" and "rear edge (portion)" may be used to designate the edges of the printing paper P corresponding to the direction in which the printing paper P is advanced during sub-scanning in the printer 22. In the present specification, the term "upper edge (portion)" corresponds to the front edge (portion) of the printing paper P, and the term "lower edge (portion)" corresponds to the rear edge (portion).

B. First Embodiment

B1. Device Structure

Figure 3:
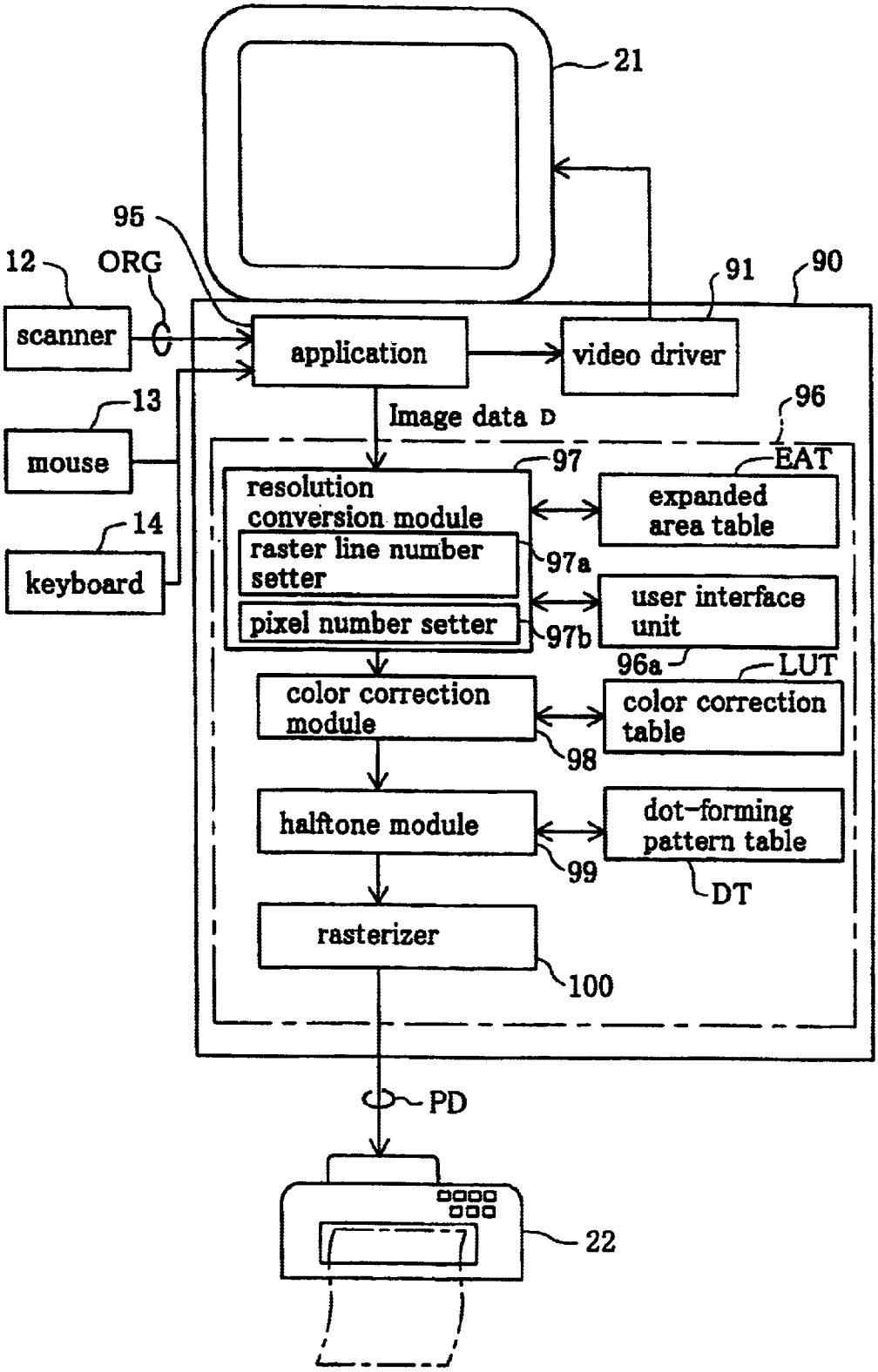
FIG. 3 is a block diagram depicting the structure of the software for the present printing device.

FIG. 3 is a block diagram depicting the structure of the software for the present printing device. In the computer 90, an application program 95 is executed within the framework of a specific operating system. The operating system contains a video driver 91 or a printer driver 96, and the application program 95 outputs the image data D to be transferred to the printer 22 by means of these drivers. The application program 95 for performing video retouching or the like allows images to be read from the scanner 12 and displayed by the CRT 21 by means of the video driver 91 while processed in a prescribed manner. The data ORG presented by the scanner 12 are in the form of primary-color image data ORG obtained by reading a color original and composed of the following three color components: red (R), green (G), and blue (B).

When the application program 95 generates a printing command, the printer driver 96 of the computer 90 receives image data from the application program 95, and the resulting data are converted to a signal that can be processed by the printer 22 (in this case, into a signal containing multiple values related to the colors cyan, magenta, light cyan, light magenta, yellow, and black). In the example shown in FIG. 3, the printer driver 96 comprises a resolution conversion module 97, a color correction module 98, a halftone module 99, and a rasterizer 100. In addition, the expanded area table EAT contains a color correction table LUT and a dot-forming pattern table DT. The application program 95 corresponds to the image data generator. The printer driver 96 corresponds to a print data generator. More specifically, the resolution conversion module 97, color correction module 98, halftone module 99, and rasterizer 100 correspond to a print data generator.

The role of the resolution conversion module 97 is to convert the resolution of the color image data handled by the application program 95 (that is, the number of pixels per unit length) into a resolution that can be handled by the printer driver 96. The resolution conversion module 97 references the expanded area table EAT when the resolution of the image data is converted. The image data are converted to a type of data that allows an image-recording area determined based on data concerning paper types and on an expanded area table EAT (which are provided in advance) to be recorded at a specified resolution. The image-recording area and the expanded area table EAT will be described in detail below.

Because the image data converted in terms of resolution in this manner are still in the form of video information composed of three colors (RGB), the color correction module 98 converts these data into the data for each of the colors (cyan (C), magenta (M), light cyan (LC), light magenta (LM), yellow (Y), and black (K)) used by the printer 22 for individual pixels while the color correction table LUT is consulted.

The color-corrected data have a gray scale with 256 steps, for example. The halftone module 99 executes a halftone routine for expressing this gray scale in the printer 22 by forming dispersed dots. The halftone module 99 executes the halftone routine upon specifying the dot formation patterns of the corresponding ink dots in accordance with the gray scale of the image data by consulting the dot-forming pattern table DT. The image data thus processed are sorted according to the data sequence to be transferred to the printer 22 by the rasterizer 100, and are outputted as final print data PD. The print data PD contain information about the amount of feed in the sub-scanning direction and information about the condition of dot recording during each main scan. The raster data (which contain print data PD) and the data specifying the feed increments in the sub-scanning direction correspond to the image data D, which substantially indicate the images to be printed. In other words, these types of data contain, as image data, information about the recording condition of the dots in the pixels inside the expanded area. In the present embodiment, the sole role of the printer 22 is to form ink dots in accordance with the print data PD without processing the images, although it is apparent that such processing can also be carried out by the printer 22.

Figure 4:
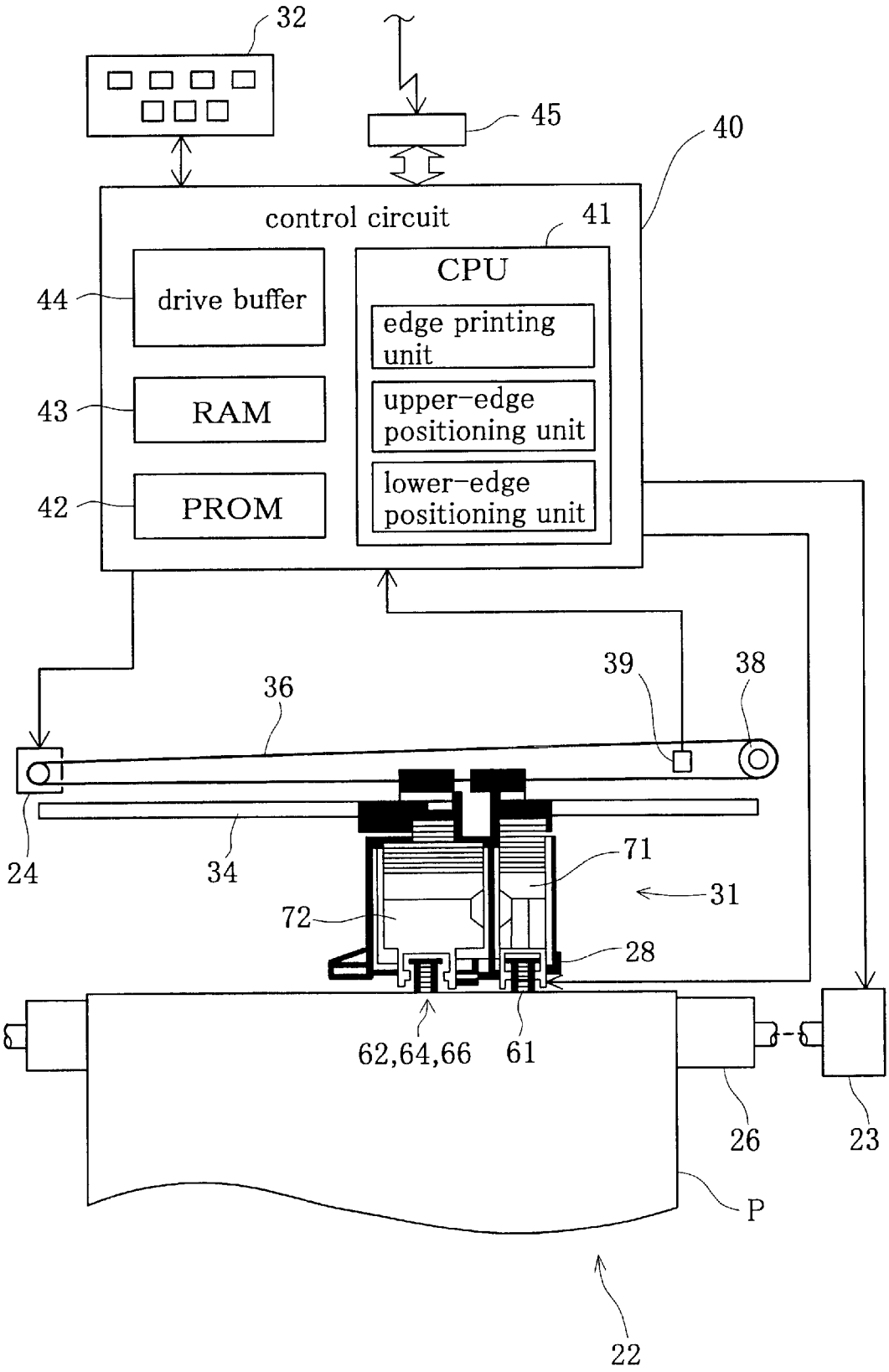
FIG. 4 is a diagram illustrating the overall structure of the printer 22.

The overall structure of the printer 22 will now be described with reference to FIG. 4. As can be seen in the drawing, the printer 22 comprises a mechanism for transporting paper P with the aid of a paper feed motor 23; guides 29*a* and 29*b* (not shown in FIG. 4) for guiding the printing paper P during transport, a mechanism for reciprocating a carriage 31 in the axial direction of the platen 26 with the aid of a carriage motor 24; a mechanism for actuating the print head 28 mounted on the carriage 31 and ejecting the ink to form ink dots; and a control circuit 40 for exchanging signals between the paper feed motor 23, the carriage motor 24, the print head 28, and a control panel 32. The printer 22 corresponds to the dot-recording unit and dot-recording device.

The mechanism for reciprocating the carriage 31 in the axial direction of the platen 26 comprises a sliding shaft 34 mounted perpendicular to the direction of transport of the printing paper P and designed to slidably support the carriage 31, a pulley 38 for extending an endless drive belt 36 from the carriage motor 24, a position sensor 39 for sensing the original position of the carriage 31, and the like.

The carriage 31 can support a cartridge 71 for black ink (K) and a color-ink cartridge 72 containing inks of the following six colors: cyan (C), light cyan (LC), magenta (M), light magenta (LM), and yellow (Y). A total of six ink-ejecting heads 61 to 66 are formed in the print head 28 in the bottom portion of the carriage 31, and introduction tubes for guiding the ink from the ink tank to each color head are provided to the bottom portion of the carriage 31. Mounting the cartridge 71 for the black (K) ink and the cartridge 72 for the color inks on the carriage 31 causes the introduction tubes to enter the connection holes provided to each cartridge, and allows the ink to be fed from the ink cartridges to the ejection heads 61 to 66.

Figure 5:
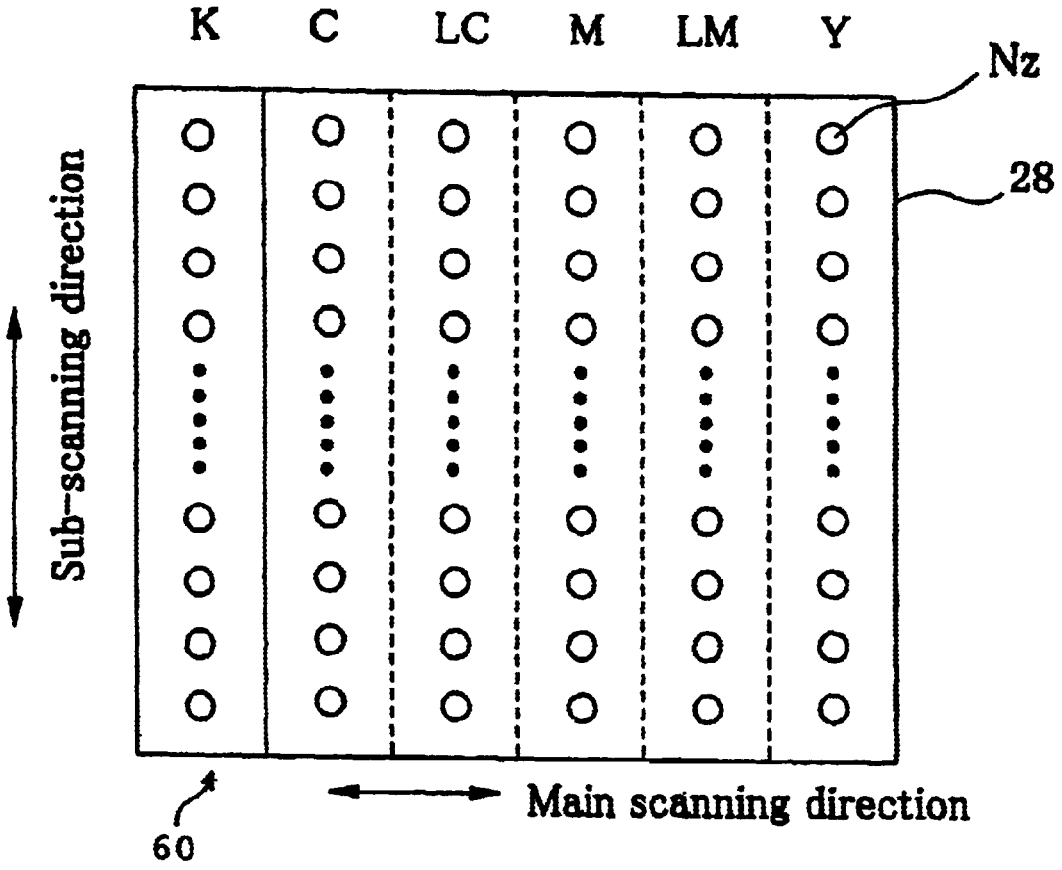
FIG. 5 is a plan view depicting the arrangement of nozzle units for each color in a print head unit 60.

FIG. 5 is a diagram depicting the arrangement of the ink-jet nozzles Nz in the ink-ejecting heads 61–66. These nozzles form six nozzle arrays for ejecting the ink of each color (black (K), cyan (C), light cyan (LC), magenta (M), light magenta (LM), and yellow (Y)), and the 48 nozzles of each array form a single row at a constant pitch k. Six nozzle arrays are thus aligned in the main scanning direction. More specifically, a pair of nozzles corresponding to each nozzle array are placed in aligned fashion on the same main scan line. Nozzle pitch is a value equal to the number of raster lines (that is, pixels) accommodated by the interval between the nozzles on the print heads in the sub-scanning direction. For example, nozzles whose intervals correspond to three interposed raster lines have a pitch k of 4.

Figure 6:
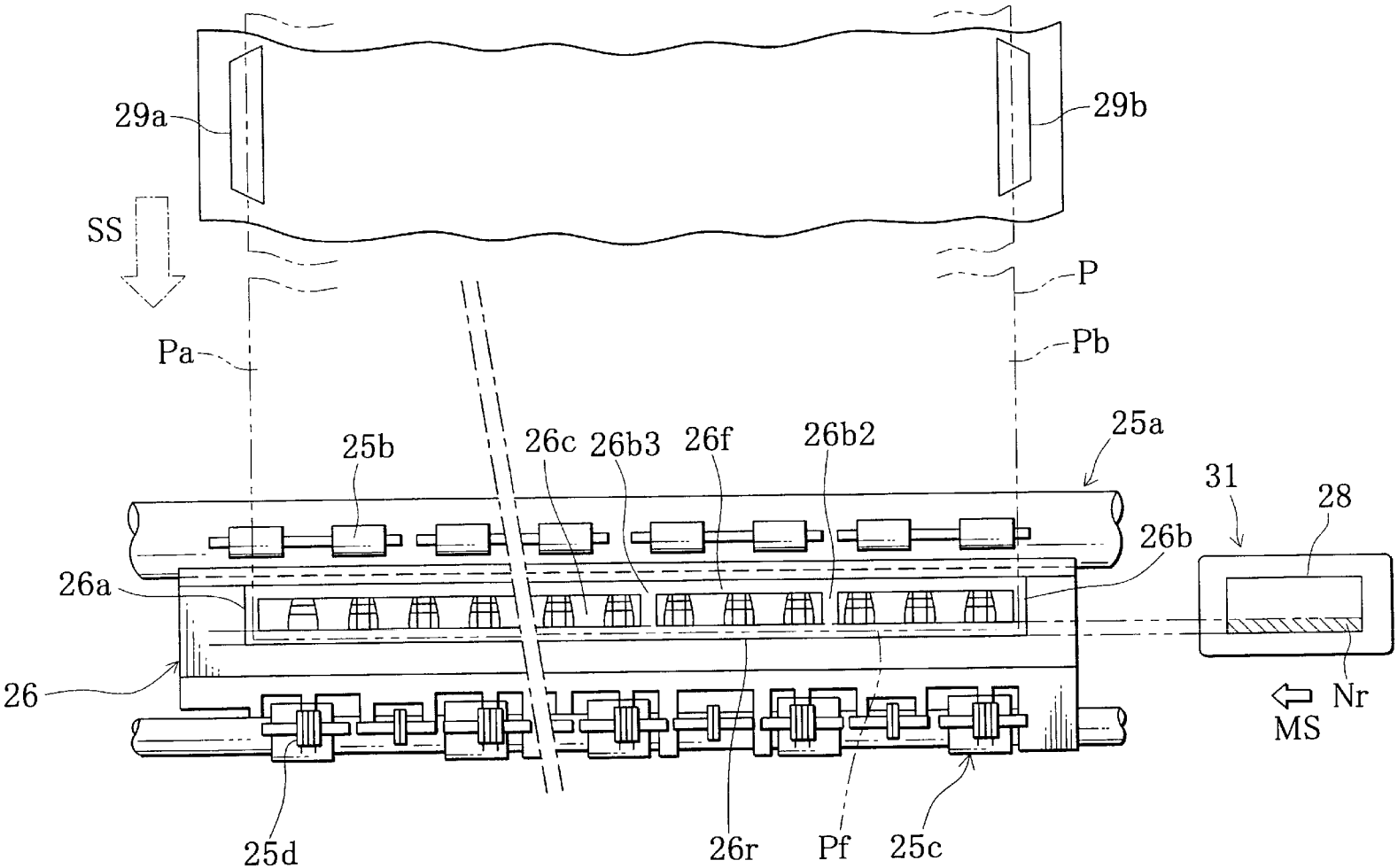
FIG. 6 is a plan view depicting the periphery of a platen 26.

FIG. 6 is a plan view depicting the periphery of the platen 26. The width of the platen 26 in the sub-scanning direction is greater than the maximum width of the printing paper P that can be accommodated by the printer 22. Upstream paper feed rollers 25*a* and 25*b* are provided upstream of the platen 26. Whereas the upstream paper feed roller 25*a* is a single drive roller, the upstream paper feed roller 25*b* comprises a plurality of freely rotating small rollers. Downstream paper feed rollers 25*c* and 25*d* are also provided downstream of the platen. The downstream paper feed roller 25*c* comprises a plurality of rollers on a drive shaft, and the downstream paper feed roller 25*d* comprises a plurality of freely rotating small rollers. Slots parallel to the axis of rotation are formed in the external peripheral surface of the downstream paper feed roller 25*d*. Specifically, the downstream paper feed roller 25*d* has radial teeth (portions between slots) in the external peripheral surface thereof and appears to be shaped as a gear when viewed in the direction of the axis of rotation. The downstream paper feed roller 25*d* is commonly referred to as a milled roller and is designed to press the printing paper P against the platen 26. The downstream paper feed roller 25*c* and upstream paper feed roller 25*a* rotate synchronously at the same peripheral speed.

The print head 28 moves back and forth in the main scanning direction over the platen 26 sandwiched between the upstream paper feed rollers 25*a* and 25*b* and the downstream paper feed rollers 25*c* and 25*d*. The printing paper P is held by the upstream paper feed rollers 25*a* and 25*b* and the downstream paper feed rollers 25*c* and 25*d*, and an intermediate portion thereof is supported by the upper surface of the platen 26 while disposed opposite the rows of nozzles in the print head 28. The paper is fed in the sub-scanning direction by the upstream paper feed rollers 25*a* and 25*b* and the downstream paper feed rollers 25*c* and 25*d*, and images are sequentially recorded by the ink ejected from the nozzles of the print head 28.

The platen 26 is provided with an upstream slot 26*f* and a downstream slot 26*r*, which are located on the upstream and downstream sides, respectively, in the sub-scanning direction. The width of the upstream slot 26*f* or downstream slot 26*r* in the main scanning direction is greater than the maximum width of the printing paper P that can be accommodated by the printer 22. In addition, absorbent members 27*f* and 27*r* for accepting and absorbing ink droplets Ip are disposed in the bottom portions of the upstream slot 26*f* and downstream slot 26*r*, respectively. The downstream slot 26*r* is disposed opposite those nozzles Nz of the print head 28 that form a downstream group of nozzles Nr (the hatched group of nozzles in FIG. 6) containing the extreme downstream nozzle. The upstream slot 26*f* is disposed opposite those nozzles of the print head 28 that form an upstream group of nozzles Nf (not shown in FIG. 6) containing the extreme upstream nozzle.

The upstream slot 26*f* and downstream slot 26*r* correspond to the first slot.

The platen 26 further comprises a left slot 26*a* and a right slot 26*b*, which extend in the sub-scanning direction to connect the two corresponding ends of the upstream slot 26*f* and downstream slot 26*r*. The left slot 26*a* and right slot 26*b* are provided within a range (in the sub-scanning direction) greater than the range within which ink droplets can be deposited by the nozzles of the print head. The distance between the center lines (in the main scanning direction) of the left slot 26*a* and right slot 26*b* is selected such that the width (in the main scanning direction) of the portion of the printing paper on which images can be recorded by the printer 22 is equal to the maximum width of the printing paper P. The left slot 26*a* and right slot 26*b* should be configured such that one of the side-edge portions (side-edge portion Pa) of the printing paper P in the main scanning direction is disposed above the left slot 26*a*, and the other side-edge portion (side-edge portion Pb) is disposed above the right slot 26*b* when the widest possible printing paper P on which images can be printed by the printer 22 is brought to a specified main-scan position by the guides 29*a* and 29*b*. An arrangement in which the side-edge portions of the printing paper P are disposed at a point located inward or outward from the center lines of the left slot 26*a* and right slot 26*b* can therefore be adopted in addition to an embodiment in which the side-edge portions of the printing paper P are disposed along the center lines of the left slot 26*a* and right slot 26*b* when the printing paper is brought into a specified position in this manner. The upstream slot 26*f*, downstream slot 26*r*, left slot 26*a*, and right slot 26*b* are connected to each other, forming a quadrilateral slot.

The platen 26 also comprises right slots 26*b*2 and 26*b*3. These slots extend in the sub-scanning direction and connect together the intermediate portions of the upstream slot 26*f* and downstream slot 26*r*. The distance between the center lines of the right slot 26*b*2 and the left slot 26*a* is selected such that the resulting width is less than the maximum width (in the sub-scanning direction) of printing paper P recordable with the printer 22, and is equal to the width of a specific printing paper P. The same applies to the right slot 26*b*3. If the printer 22 can print images up to size A3 in a lengthwise arrangement, the distance between the center lines of the left slot 26*a* and right slot 26*b* corresponds to the length of the short side of size A3 paper. It may, for example, be possible in this case to arrange the left slot 26*a* and right slot 26*b*2 such that the distance between the center lines thereof is equal to the length of the short side for size B4, and to arrange the left slot 26*a* and right slot 26*b*3 such that the distance between the center lines thereof is equal to the length of the short side of size A4 paper. It is also possible to provide a right slot that corresponds to size A5, a right slot that corresponds to the postcard size, and the like. The group composed of the left slot 26*a* and right slot 26*b*, the group composed of the left slot 26*a* and right slot 26*b*2, or the group composed of the left slot 26*a* and right slot 26*b*3 correspond to the pair of lateral slots.

Absorbent members 27 for absorbing ink droplets Ip are disposed at the bottom of each slot. The absorbent members 27 for each of the slots are sometimes designated 27*f*, 27*r*, 27*a*, 27*b*, 27*b*2, and 27*b*3 in accordance with the labeling of the slots.

The printing paper P passes above the openings of the upstream slot 26*f* and downstream slot 26*r* when fed in the sub-scanning direction by the upstream paper feed rollers 25*a* and 25*b* and the downstream paper feed rollers 25*c* and 25*d*. The printing paper P is positioned on the platen 26 by the guides 29*a* and 29*b* in the main scanning direction such that the left edge Pa is disposed above the left slot 26*a*, and the right edge Pb is disposed above the right slot 26*b*, 26*b*2, or 26*b*3, depending on the width of the printing paper.

The inner structure of the control circuit 40 (see FIG. 4) belonging to the printer 22 will now be described. The control circuit 40 contains the following units in addition to CPU 41, PROM 42, and RAM 43: a PC interface 45 for exchanging data with the computer 90, a drive buffer 44 for outputting the ON and OFF signals of the ink jet to the ink-ejecting heads 61–66, and the like. These elements and circuits are connected together by a bus. The control circuit 40 receives the dot data processed by the computer 90, temporarily stores them in the RAM 43, and outputs the results to the drive buffer 44 according to specific timing.

In the printer 22 thus configured, the carriage 31 is reciprocated by the carriage motor 24 while paper P is transported by the paper feed motor 23, the piezoelement of each of the nozzle units belonging to the print head 28 is actuated at the same time, ink droplets Ip of each color are ejected, and ink dots are formed to produce multicolored images on the paper P.

In the printer of the present embodiment, the areas near the top and lower edges of printing paper are printed differently from the intermediate area of the printing paper because the upper edge Pf of the printing paper P is printed over the downstream slot 26*r*, and the lower edge Pr is printed over the upstream slot 26*f*. In the present specification, the routine whereby images are printed in the intermediate area of printing paper will be referred to as an "intermediate routine," the routine whereby images are printed in the area near the upper edge of printing paper will be referred to as a "upper-edge routine," and the routine whereby images are printed in the area near the lower edge of printing paper will be referred to as a "lower-edge routine."

B2. Image-recording Area

Figure 7:
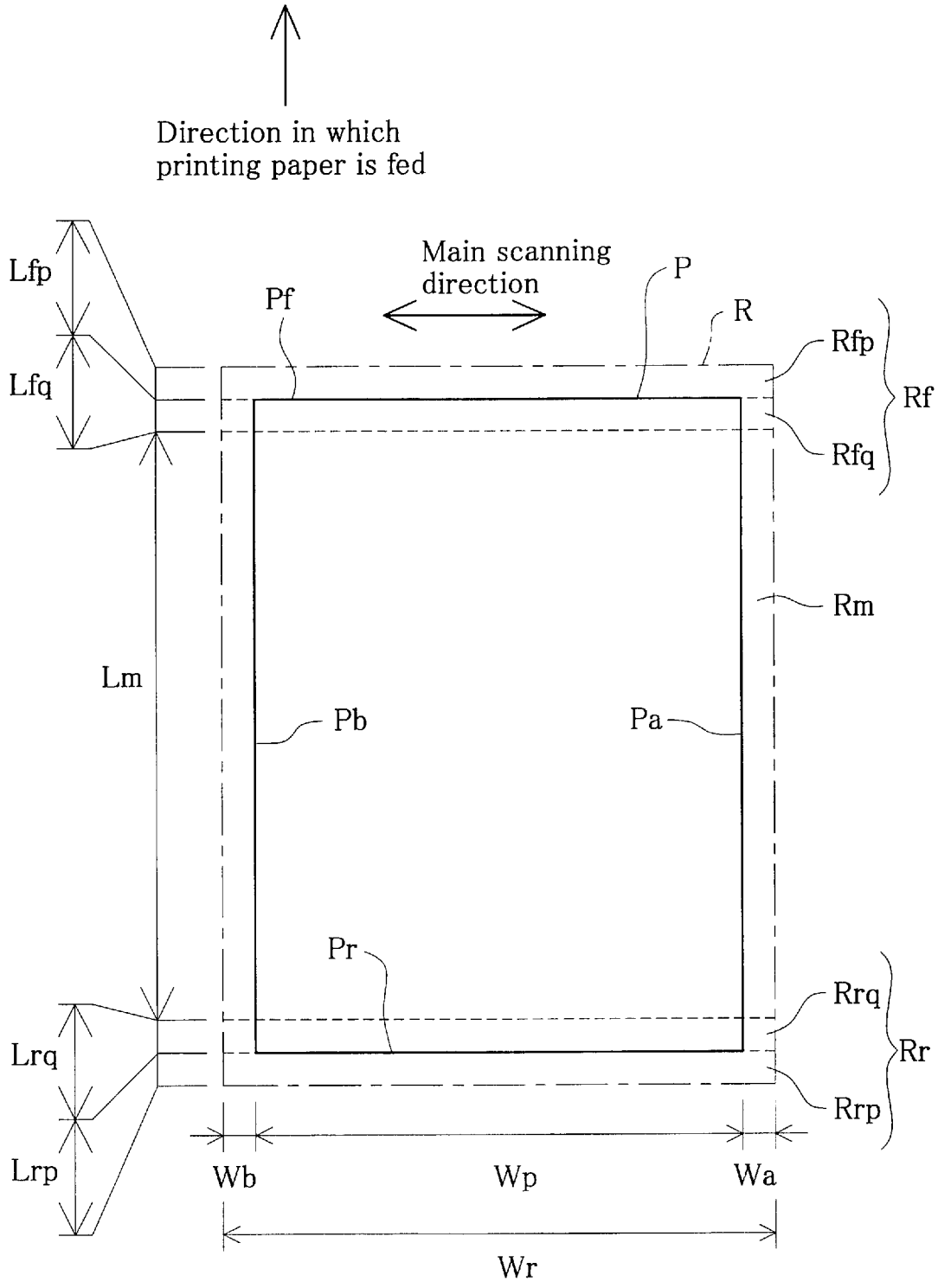
FIG. 7 is a diagram depicting the relation between the image-recording area R and the printing paper P.

FIG. 7 is a diagram depicting the relation between the image-recording area R and printing paper P. In the present embodiment, the image-recording area R is selected as an area extending beyond the upper edge Pf of the printing paper P outside the printing paper P. Similarly, the image-recording area R is selected as an area extending beyond the edges of the printing paper P outside the printing paper P for the lower edge Pr, left edge Pa, and right edge Pb of the printing paper P. Consequently, FIG. 7 depicts the relation between the area R for recording images during printing and the size of the printing paper P, on the one hand, and the intended position of the recording area R and the arrangement of the printing paper P, on the other hand, in accordance with the present embodiment. The image-forming area will be referred to hereinbelow as "the expanded area R." Because the terms "left" and "right" for the left edge Pa and right edge Pb of the printing paper P are selected to match the terms "left" and "right" for the printer 22, the actual left and right sides of the printing paper P are the reverse of those designated by the terms "left edge Pa" and "right edge Pb."

The dimensions of the expanded area R in the main scanning direction (horizontal direction in FIG. 7) in the area beyond the left and right edges Pa and Pb of the printing paper P vary with the dimensions of the printing paper P in the main scanning direction. The portion of the expanded area R lying beyond the left edge Pa of the printing paper P is referred to as the external left edge portion Rap of the recording area, and the portion lying beyond the right edge Pb is referred to as the external right edge portion Rbp of the recording area. It is assumed that the width Wa of the external left edge portion Rap and the width Wb of the external right edge portion Rbp are equal to each other. It is also possible to select different values for the Wa and Wb.

The width Wr of the expanded area can therefore be expressed by the equation Wr=Wp+Wa+Wb, where Wp is the width of the printing paper in the main scanning direction (this width varies with the type of paper), Wa is the width of the portion of the expanded area R specified for the region beyond the left edge Pa, and Wb is the width of the portion of the expanded area R specified for the region beyond the right edge Pb. The width Wr of the expanded area R is greater than the width of the printing paper P (in the direction from left to right) but does not exceed the distance between the side walls of the exterior portions of the left slot 26*a* and right slot 26*b*. The right slot defines the width of the expanded area R. This slot is the right slot 26*b* in the case of a widest possible printing paper for which the printer 22 can be used, and the right slot 26*b*2 or right slot 26*b*3 in the case of narrower printing paper.

By contrast, the dimensions of the expanded area R in the sub-scanning direction (vertical direction in FIG. 7) in the region beyond the upper edge Pf and lower edge Pr of the printing paper P vary with the materials and dimensions (including materials other than paper) of the printing paper P in the sub-scanning direction. The portion of the expanded area R lying beyond the upper edge Pf of the printing paper P is referred to as the external upper edge portion Rfp of the recording area, and the portion lying beyond the lower edge Pr is referred to as the external lower edge portion Rrp of the recording area.

Images are recorded in the external upper edge portion Rfp solely by the nozzles Nr disposed opposite the downstream slot 26*r*. These nozzles are some of the nozzles provided to the print head 28. As used herein, the term "only a specific group of nozzles is used" refers to the fact that the only nozzles used are those belonging to a specific group of nozzles. At least part of a specific group of nozzles should be used. Similar to the external upper edge portion Rfp, the portion of the expanded area R disposed inward from the upper edge Pf of the printing paper P adjacent to the external upper edge portion Rfp is recorded solely with the nozzles Nr. This portion is referred to as "an internal upper edge portion Rfq." The external upper edge portion Rfp and internal upper edge portion Rfq are collectively referred to as "the front edge portion Rf of the expanded area R." Images are recorded in the external lower edge portion Rrp solely by the nozzles Nf disposed opposite the upstream slot 26*f*. These nozzles are some of the nozzles provided to the print head 28. Similar to the external lower edge portion Rrp, the portion disposed inward from the lower edge Pr of the printing paper P adjacent to the external lower edge portion Rrp is recorded solely with the nozzles Nf. This portion is referred to as "an internal lower edge portion Rrq." The external lower edge portion Rrp and internal lower edge portion Rrq are collectively referred to as "the rear-edge portion Rr of the expanded area R."

FIG. 8 is a diagram depicting an example of an expanded area table EAT. The expanded area table EAT (see FIG. 3) illustrates the manner in which the length Lfp of the external upper edge portion Rfp, the length Lfq of the internal upper edge portion Rfq, the length Lrp of the external lower edge portion Rrp, the length Lrq of the internal lower edge portion Rrq, the width Wa of the external left edge portion Rap and the width Wb of the external right edge portion Rbp can be selected in accordance with the type of printing paper. In FIG. 8, information about the expanded areas of printing paper (material: P1, P2, P3) is shown as a table. Plain paper, photoprint paper, special glossy film, special OHP sheets, and the like may be cited as examples of such printing paper materials. These materials differ from each other in terms of the ease with which they slide during sub-scanning, and commonly generate errors of different magnitudes during sub-scanning. The resolution conversion module 97 references an expanded area table EAT containing information such as that shown in FIG. 8, and converts image data to data that allow images to be recorded in the expanded area at a specific resolution. In the process, the position of the expanded area R in relation to the printing paper P is set because the following values are defined: the length Lfp of the external upper edge portion Rfp, the length Lfq of the internal upper edge portion Rfq, the length Lrp of the external lower edge portion Rrp, and the length Lrq of the internal lower edge portion Rrq. The expanded area table EAT corresponds to the area size memory. As hardware, the memory containing the expanded area table EAT corresponds to an area size memory. In the first embodiment, the length Lfp of the external upper edge portion Rfp, the length Lfq of the internal upper edge portion Rfq, the length Lrp of the external lower edge portion Rrp, and the length Lrq of the internal lower edge portion Rrq are expressed as millimeters, but these lengths may also be stored as numbers of raster lines. Here, the number of raster lines can be calculated as (Length/(1/Recording density)). For example, the number of raster lines can be calculated by rounding off the equation ((Lfp/25.4)/(1/720)) to the nearest integer when the goal is to express the length Lfp [mm] of the external upper edge portion Rfp as the number of raster lines at a recording density of 720 dpi.

FIG. 2 is a diagram depicting the relation between an expanded area and the size of printing paper. The size of an expanded area R and its arrangement in relation to printing paper P are specified when the dimensions of the portion of the expanded area specified for a region beyond the edges on the four sides of the printing paper P are selected in the manner shown in FIG. 8. The relation between the printing paper P and the expanded area R assumes the shapes shown in FIGS. 2A–2F because the dimensions of the expanded area R vary with the dimensions and material of the printing paper P. In the drawings, the corresponding recording area R are labeled as R1–R6, and the sheets of printing paper P are labeled as P1–P6. The symbols 1–6 are attached in the same manner to the front-edge portion Rf and rear-edge portion Rr of the expanded area R.

Figure 2A:
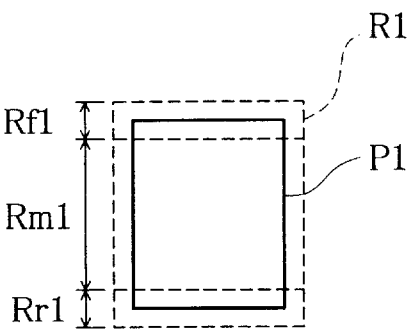
FIGS. 2A–F are diagrams depicting the relation between the printing paper and the area for forming images in accordance with an embodiment of the present invention.
Figure 2B:
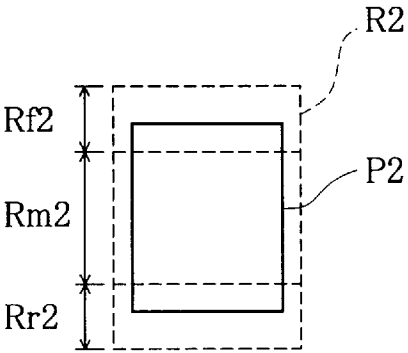
Figure 2C:
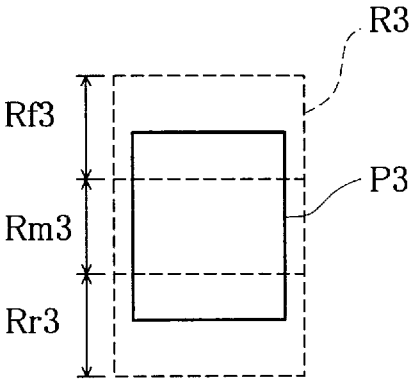
Figure 2D:
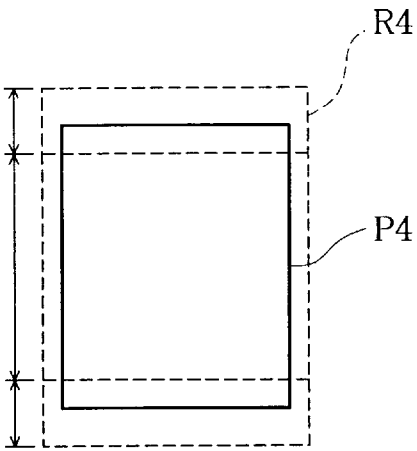
Figure 2E:
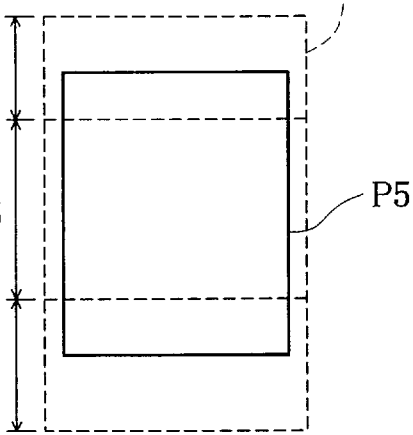
Figure 2F:
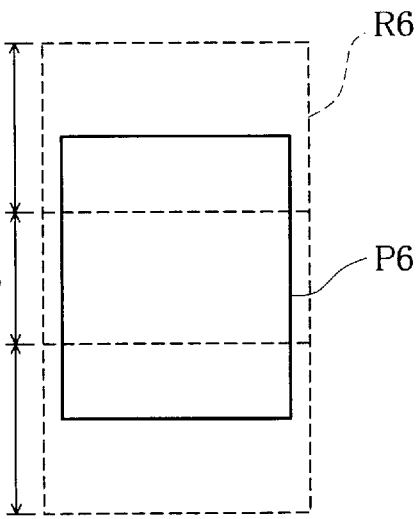

The printing paper P4 in FIG. 2D is larger than the printing paper P1 in FIG. 2A. The expanded area R4 for recording images on the printing paper P4 is therefore made larger than the expanded area R1 of the printing paper P1. In addition, the sheets of printing paper P1, P2, and P3 have the same size but different materials, and the ease with which the paper slides during sub-scanning increases in the sequence P1, P2, P3. Consequently, the length of the expanded area R in the sub-scanning direction with respect to the corresponding sheets of printing paper increases in the sequence R1, R2, R3. More specifically, the length of the portion of the expanded area R in the sub-scanning direction between the front-edge portion Rf and rear-edge portion Rr in which images can be recorded above the slot increases in the sequence R1, R2, R3.

Although the dimensions of either the external upper edge portion Rfp or the internal upper edge portion Rfq or the front-edge portion Rf may be varied herein in accordance with the type of printing paper, it is more preferable to vary the dimensions of both these edges in accordance with the type of printing paper. Similarly, the dimensions of either the external lower edge portion Rrp or the internal lower edge portion Rrq of the rear-edge portion Rr may be varied in accordance with the type of printing paper, but it is more preferable to vary the dimensions of both these edges in accordance with the type of printing paper.

FIGS. 9A and 9B are tables containing examples of the number of pixels and raster lines selected for the parts of the expanded area beyond the edges on the four sides of printing paper P. The size of an expanded area R and its arrangement in relation to printing paper P are specified as shown in FIGS. 6 and 7, and an expanded area table EAT (see FIG. 2) contains information about the expanded area R in the form of raster line and pixel numbers.

For example, the length Lfp of the external upper edge portion Rfp of printing paper (size: A4; material: P1) in the sub-scanning direction is 3.0 mm, as shown in FIG. 8. As shown in FIG. 9A, the external upper edge portion Rfp must consist of 85 raster lines in order to allow the length Lfp of the external upper edge portion Rfp in the sub-scanning direction to reach a value of 3.0 mm when the recording density of raster lines in the sub-scanning direction and the recording density of pixels in the main scanning direction are equal to 720 dpi (dot/inch). By contrast, the external upper edge portion Rfp must consist of 170 raster lines in order to allow the Lfp to reach a value of 3.0 mm when the recording density of raster lines and the recording density of pixels in the main scanning direction are equal to 1440 dpi (dot/inch), as shown in FIG. 9B. Here, the number of raster lines can be calculated as (Length/(1/Recording density)). For example, the number of raster lines can be calculated by rounding off the equation ((Lfp [mm]/25.4)/(1/720 [dpi])) to the nearest integer when the goal is to express the length Lfp [mm] of the external upper edge portion Rfp as the number of raster lines at a recording density of 720 dpi.

Similarly, the length Wa of the external left edge portion Rap of printing paper (size: postcard; material: P1) in the main scanning direction is 1.5 mm, as shown in FIG. 8. As shown in FIG. 9A, the external left edge portion Rap must consist of 43 pixels in order to allow the width Wa of the external left edge portion Rap in the sub-scanning direction to reach a value of 1.5 mm when the recording density of raster lines in the main scanning direction and the recording density of pixels in the main scanning direction are equal to 720 dpi (dot/inch). By contrast, the external upper edge portion Rfp must consist of 85 pixels in order to allow the length Lap of the external left edge portion Rap in the sub-scanning direction to reach a value of 1.5 mm when the recording density of raster lines and the recording density of pixels in the main scanning direction are equal to 1440 dpi (dot/inch), as shown in FIG. 9B.

In other words, the expanded area table EAT (see FIG. 2) contains the following information for each print mode: the number of raster lines for the external upper edge portion Rfp, internal upper edge portion Rfq, external lower edge portion Rrp, and internal lower edge portion Rrq; and the number of pixels for the external left edge portion Rap and external right edge portion Rbp, as can be seen in FIGS. 9A and 9B. The numbers of raster lines constituting the edge portions of the same type of printing paper for each print mode are specified such that the dimensions of each external upper edge portion in the sub-scanning direction are equal to each other. The same applies to the number of raster lines for the internal upper edge portion Rfq, external lower edge portion Rrp, and internal lower edge portion Rrq, and the number of pixels for the external left edge portion Rap and external right edge portion Rbp. As used herein, the term "the same type of print medium (printing paper)" refers to the same material, shape, and dimensions of the print medium.

The resolution conversion module 97 establishes the expanded area by referencing an expanded area table EAT containing information of the type such as the one shown in FIGS. 9A and 9B. Image data are converted to data that allow images to be recorded in the expanded area at a specific resolution. In the process, the position of the expanded area R in relation to the printing paper P is set because the following values are defined: the length Lfp of the external upper edge portion Rfp, the length Lfq of the internal upper edge portion Rfq, the length Lrp of the external lower edge portion Rrp, the length Lrq of the internal lower edge portion Rrq, the width Wa of the external left edge portion Rap, and the width Wb of the external right edge portion Rbp. The expanded area table EAT corresponds to the area size memory. As hardware, the memory containing the expanded area table EAT corresponds to an area size memory. During part of the routine, the resolution conversion module 97 functions as the raster line number setter and pixel number setter. These functional units are shown in FIG. 2 as the raster line number setter 97*a* and pixel number setter 97*b*.

Figure 10:
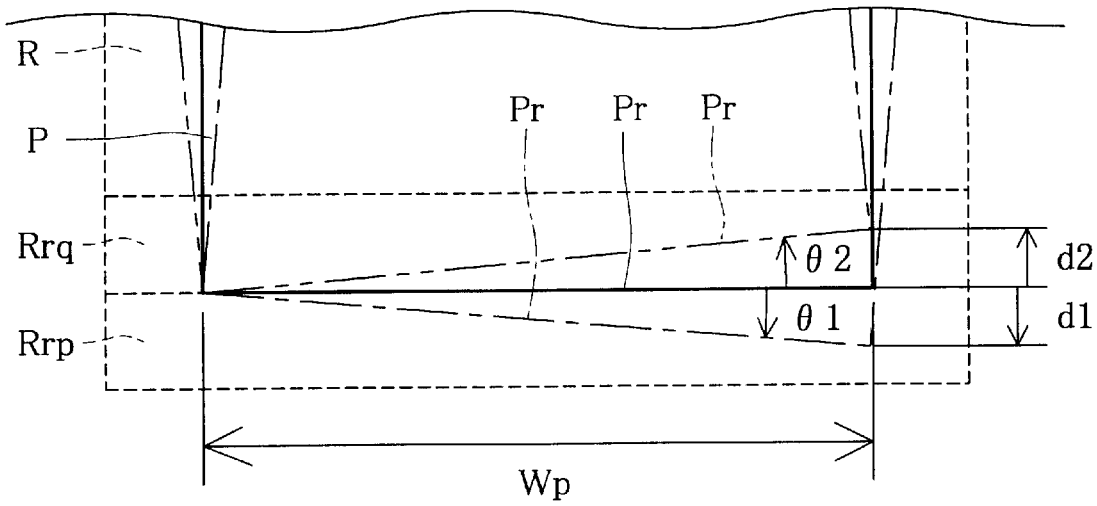
FIG. 10 is a diagram depicting the relation between the printing paper P and the expanded area R when the printing paper P is tilted.

FIG. 10 is a diagram depicting the relation between a printing paper P and an expanded area R when the printing paper P is tilted. The solid line indicates the intended position of the printing paper P, and the dashed and two-dot chain lines indicate positions assumed by the tilted printing paper P. The extent to which the edges of the printing paper P are shifted varies with the size of the printing paper P when the printing paper P tilts away from its intended position on the platen. In the specific example of a paper sheet rotated in the clockwise direction, the positional shift d1 of an angle subtended by one of the sides of the printing paper can be written as $d1=Wp\cdot\sin\theta 1$, assuming that the position of the other end can be used as reference. In the formula, Wp is the side length of the printing paper, and θ1 is the tilt angle of the printing paper. In other words, the shift dl is proportional to the side length Wp of the printing paper. The same applies to the shift d2 of a paper sheet rotated counterclockwise.

In the first embodiment, the size of the external upper edge portion Rfp, internal upper edge portion Rfq, external lower edge portion Rrp, and internal lower edge portion Rrq is determined by the size of the print medium, as shown in FIG. 8. Specifically, the size of the expanded area R and the manner in which it is arranged in relation to the printing paper P varies with the size of the printing paper. The size of the expanded area R and the manner in which it is arranged in relation to the printing paper P can therefore be selected such that the upper edge Pf or lower edge Pr of the printing paper P remains inside the rear-edge portion Rr or front-edge portion Rf of the expanded area R when the printing paper P tilts away from its intended position on the platen. In FIG. 10, the lower edge Pr of the printing paper P remains inside the rear-edge portion Rr (external lower edge portion Rrp+internal lower edge portion Rrq) when the printing paper P is tilted in either direction. It is therefore unlikely that blank spaces will form along the edges of the printing paper P when the printing paper P shifts downstream. It is also unlikely that the platen will be soiled by ink droplets when the printing paper P shifts upstream. Selecting the correct size for the recording area in accordance with the desired size of print medium P makes it possible to prevent situations in which time is wasted when images are printed by ejecting ink droplets over an area that is unnecessarily wide for a given size of print medium.

Although the above description was made with reference to the lower edge Pr of a printing paper P, the same relation between the expanded area R and the tilting of the printing paper P applies to an area disposed along the upper edge Pf. For the area disposed along the upper edge Pf, the description related to upstream shifting is replaced with a description related to downstream shifting. Specifically, blank spaces are unlikely to form along the edges of the printing paper P when the printing paper P shifts upstream. It is also unlikely that the platen will be soiled by ink droplets when the printing paper P shifts downstream.

Figure 11:
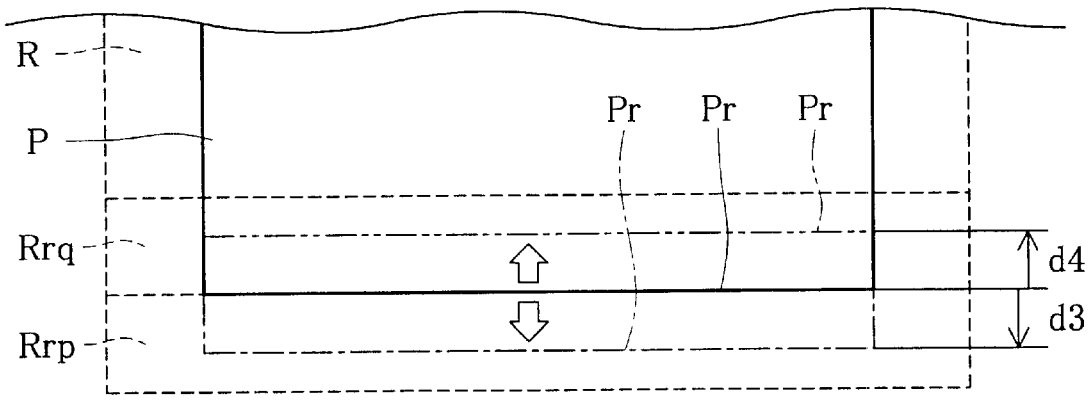
FIG. 11 is a diagram depicting the relation between the printing paper P and the expanded area R when there is a shift in sub-scanning feeding.

FIG. 11 is a diagram depicting the relation between the printing paper P and the expanded area R when the paper is shifted while fed during sub-scanning. The solid line indicates the intended arrangement of the printing paper P, and the dashed and two-dot chain lines indicate the position of the printing paper P when it is shifted while fed during sub-scanning. A small shift of a print medium from its intended feed value is designated "d3," and a considerable shift of the print medium from its intended feed value is designated "d4." The extent to which a print medium is shifted when fed during sub-scanning sometimes varies with the material of this medium. Such shifting varies with the ease with which the print medium slides during sub-scanning and the dimensions of the print medium in the sub-scanning direction.

In the first embodiment, the size of the external upper edge portion Rfp, internal upper edge portion Rfq, external lower edge portion Rrp, and internal lower edge portion Rrq is determined in accordance with the material and dimensions of the print medium, as shown in FIG. 8. Specifically, the size of the expanded area R and the manner in which this area is arranged in relation to the printing paper P are varied in accordance with the material and dimensions of the print medium. Consequently, the size of the expanded area R and the manner in which it is arranged in relation to the printing paper P can be selected in an appropriate manner for each type of a variety of print media having different sizes and composed of different materials such that the upper edge Pf or lower edge Pr remains inside the rear-edge portion Rr or front-edge portion Rf of the expanded area R when the printing paper P is shifted during feeding. It is therefore unlikely that blank spaces will form along the edges of the printing paper P when excessive sliding occurs during sub-scanning and the printing paper P shifts downstream. It is also unlikely that the platen will be soiled by ink droplets when the printing paper P shifts upstream. It is also possible to prevent situations in which time is wasted during printing as a result of the fact that ink droplets are ejected over an unnecessarily large area of a print medium that resists to slippage when fed during sub-scanning. Although the above description was given with reference to the lower edge Pr of a printing paper P, the relation between the expanded area R and the feeding of the printing paper P during sub-scanning remains the same for the area along the upper edge Pf.

In FIG. 11, the lower edge Pr of the printing paper P remains inside the lower-edge portion Rr (external lower edge portion Rrp+internal lower edge portion Rrq) when the printing paper P is shifted in either direction. It is therefore possible to prevent blank spaces from forming along the edges of the printing paper P, or the platen from being soiled by ink droplets.

Thus, the first embodiment is such that blank spaces are unlikely to form along the edges of the printing paper P when excessive slippage occurs in the direction of sub-scanning, and the printing paper P is shifted downstream. The platen is unlikely to be soiled by ink droplets when the printing paper P shifts downstream. It is also possible to prevent situations in which time is wasted during printing as a result of the fact that ink droplets are ejected over an unnecessarily large area when the print medium is fed with high accuracy in the direction of sub-scanning. Although the above description was made with reference to the lower edge Pr of a printing paper P, the same relation between the expanded area R and the shifting of the printing paper P in the direction of sub-scanning applies to the area disposed along the upper edge Pf.

The expanded area table EAT (see FIG. 3) also contains the following information for each print mode: the number of raster lines in the external upper edge portion Rfp, internal upper edge portion Rfq, external lower edge portion Rrp, and internal lower edge portion Rrq; and the number of pixels in the external left edge portion Rap and external right edge portion Rbp, as shown in FIGS. 9A and 9B. The dimensions of the portions of the expanded area R selected for the areas beyond the edges of the printing paper P can therefore be kept constant.

B3. Print Routine Sequence

Figure 12:
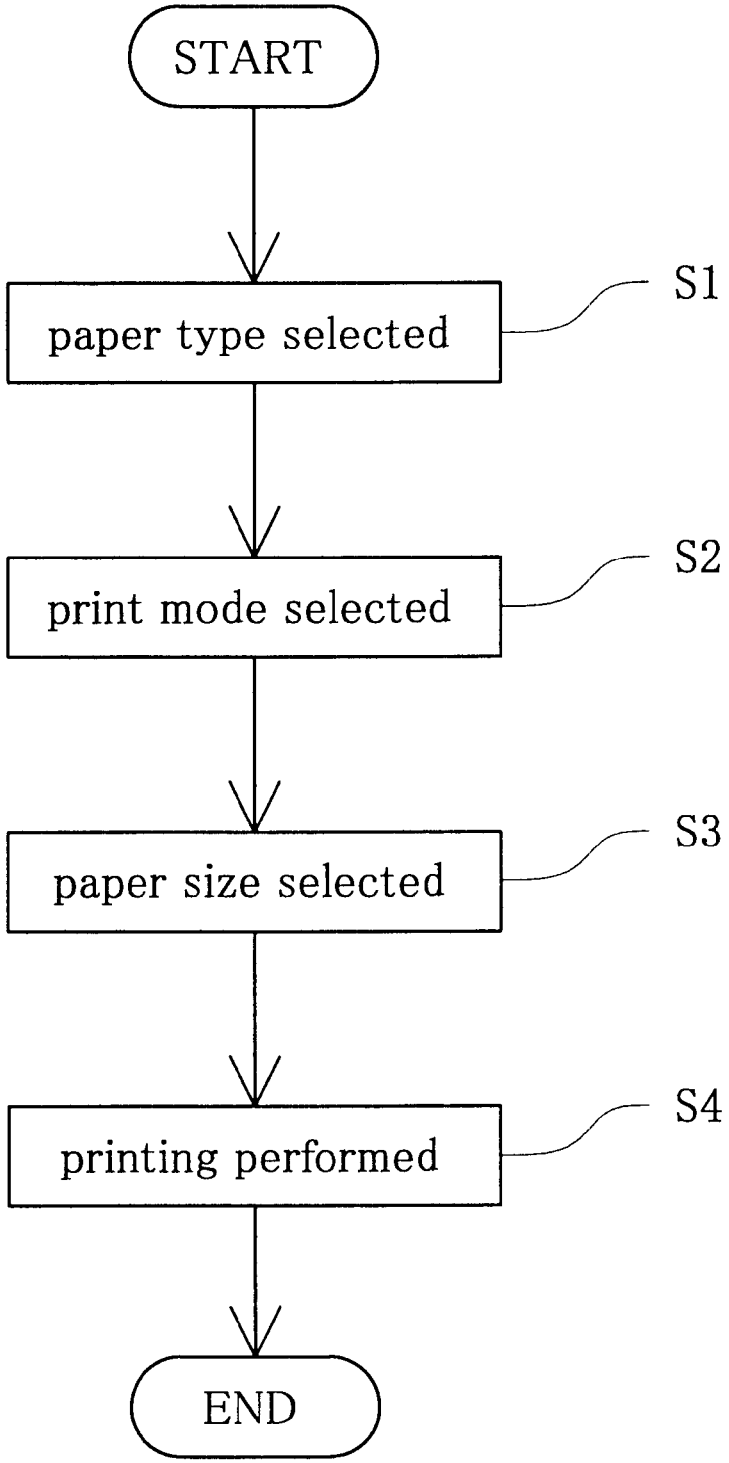
FIG. 12 is a flowchart depicting the manner in which the user operates the driver after a print command has been issued by the application program.
Figure 13:
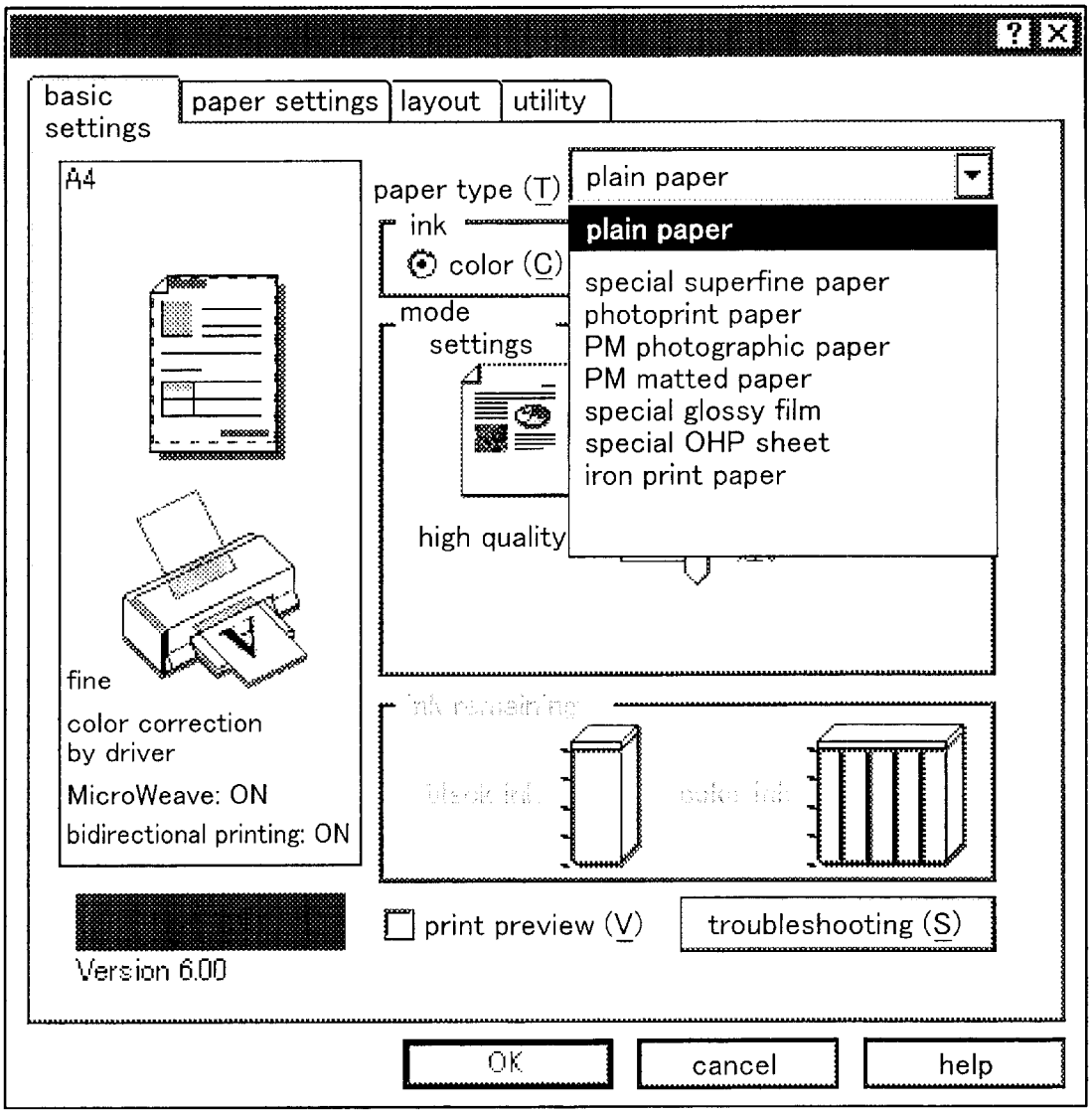
FIG. 13 is a diagram depicting the window for displaying printing paper materials.

FIG. 12 is a flowchart depicting the manner in which the user operates the driver after a print command has been issued by the application program. FIG. 13 is a diagram depicting the window for displaying printing paper materials. When the user sends a print command to the application program 95, the application program 95 issues a print command to the printer driver 96. The printer driver 96 then displays a "print" window on the CRT 21 (see FIG. 3). A window such as the one shown in FIG. 13 appears when the user clicks the "printer properties" icon on the "print" window.

In step S1 in FIG. 12, the user first selects the "basic settings" tab from among the plurality of tabs available in the window in FIG. 13, and selects the paper type (material) from the "paper type" menu. In the window shown in FIG. 13, "paper type" designates the printing paper material referred to in the present specification. In the case shown in FIG. 13, the plain paper option is selected.

Figure 14:
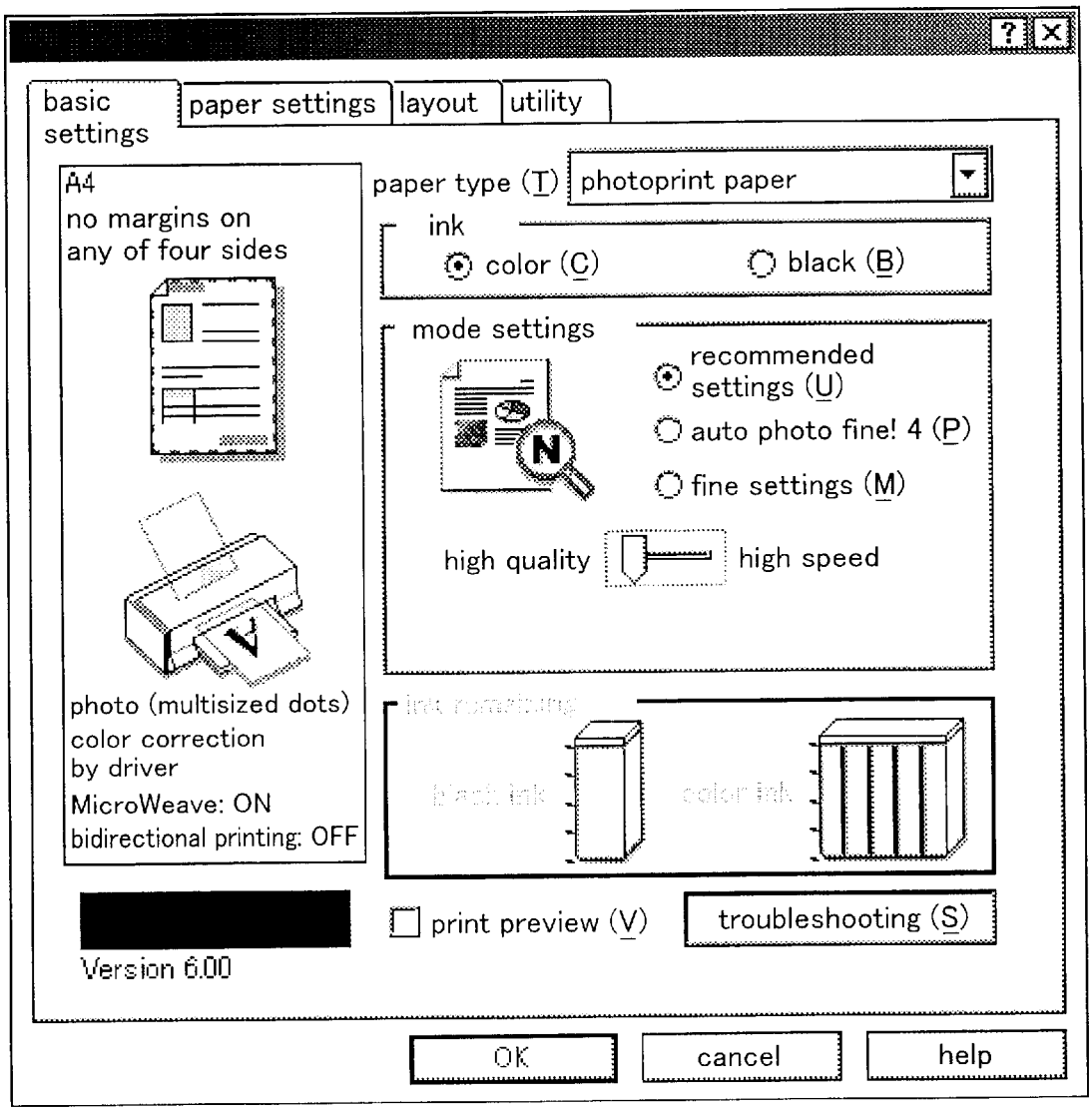
FIG. 14 is a diagram depicting the window for displaying printing paper materials.

For example, the window in FIG. 13 will assume the form shown in FIG. 14 when the "photoprint paper" option is selected in this case.

Figure 15:
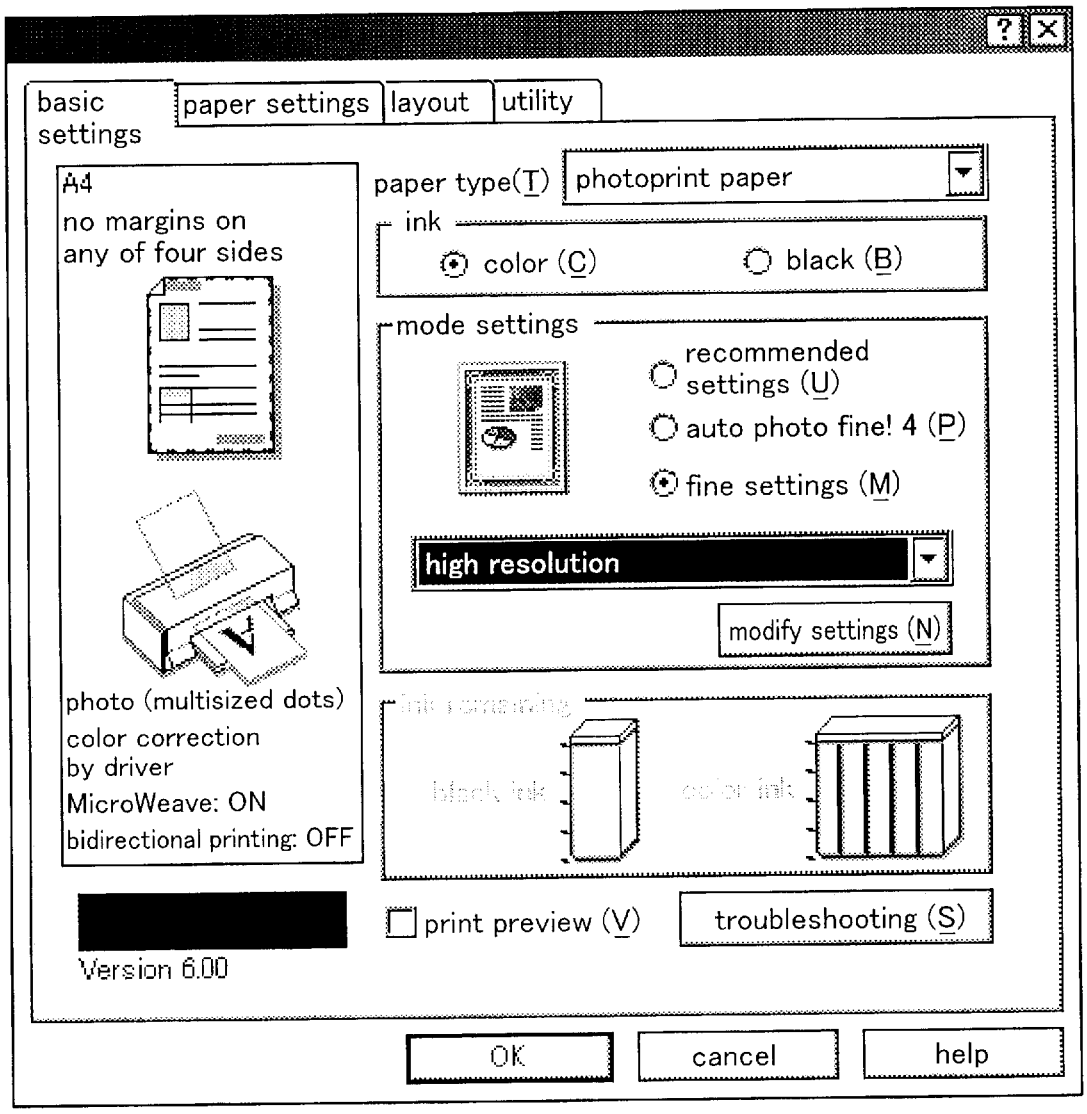
FIG. 15 is a diagram depicting the window for displaying pixel recording densities.

FIG. 15 is a diagram depicting a window for displaying the recording density of an image. After the printing paper has been selected, the option "fine setting" is checked in the "mode setting" field in the middle part of the window shown in FIG. 14. When this is done, the window assumes the form shown in FIG. 15, and a "recording density (print mode)" window appears. The user may, for example, select the "high resolution" print mode in step S2 (see FIG. 12), as shown in FIG. 15. Selecting "high resolution" will cause images to be printed at a higher recording density than the regular recording density.

The user can select "high quality" or "high speed" after selecting "recommended settings" option instead of the "high resolution" option from the mode settings, as shown in FIG. 14. Selecting either mode will preserve the regular recording density, but when "high speed" is selected, images are printed in both directions without MicroWeave printing. By contrast, selecting the "high quality" option will turn on the MicroWeave feature and will allow images to be. printed in a single direction (bidirectional printing will not occur). MicroWeave printing, also referred to as overlap printing, is a printing system in which the pixels of a single raster are printed using various nozzles during a plurality of main scans. Unidirectional printing is a printing system in which dots are formed in a single direction of main scanning, and bidirectional printing is a printing system in which dots are formed by means of reciprocating main scanning. In the first embodiment, the raster and pixel numbers of the expanded area are specified in accordance with the pixel recording density (see FIG. 9), but the raster and pixel numbers of the expanded area may also be selected by taking these printing methods into account.

Figure 16:
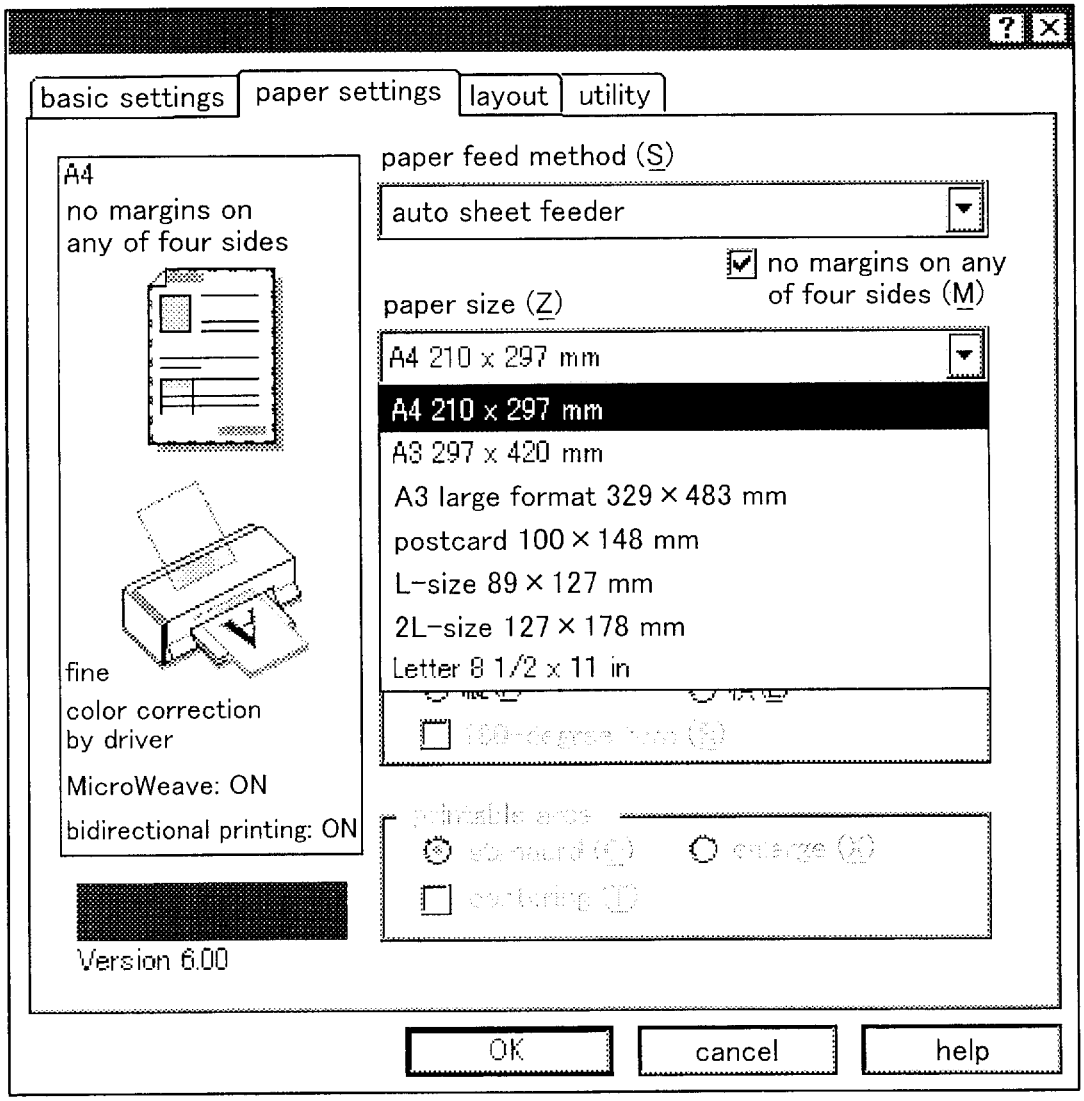
FIG. 16 is a diagram depicting the window for displaying printing paper sizes.

FIG. 16 is a diagram depicting a window for displaying the size of printing paper. After selecting the print mode in step S2, the user selects the second tab ("paper settings") on the left in step S3, and selects paper size from the "paper size" menu, as shown in FIG. 16. "A4" is selected in the case shown in FIG. 16.

The user then clicks the "OK" icon in the lower portion of the window in FIG. 16 and clicks the "OK" icon in the "printing" window. At this point, the printer driver 96 initiates a resolution conversion by the resolution conversion module 97 and executes a print routine (step S4). The manner in which the above-described steps S1–S3 are specified is not limited to the sequence described with reference to FIG. 12 and can be performed according to a sequence in which step S2 is followed first by step S1 and then by step S3. In other words, any sequence can be specified as long as the paper size, material, and print mode are specified before the printing is started. The user-interface screen (examples are shown in FIGS. 13–16) used by the user to send commands (selections) to the printer driver 96 is displayed on the CRT 21 by the printer driver 96. In other words, the printer driver 96 functions as the user interface unit. This user interface unit (functional unit) is shown as unit 96*a* in FIG. 2. A mouse 13 or keyboard 14 (see FIG. 2) can be used by the user to send the commands (selections) to the printer driver 96 via the user interface screen. In other words, the mouse 13 and keyboard 14 function as input devices.

B4. Dot Forming (i) Upper-edge Routine of First Embodiment

Figure 17:
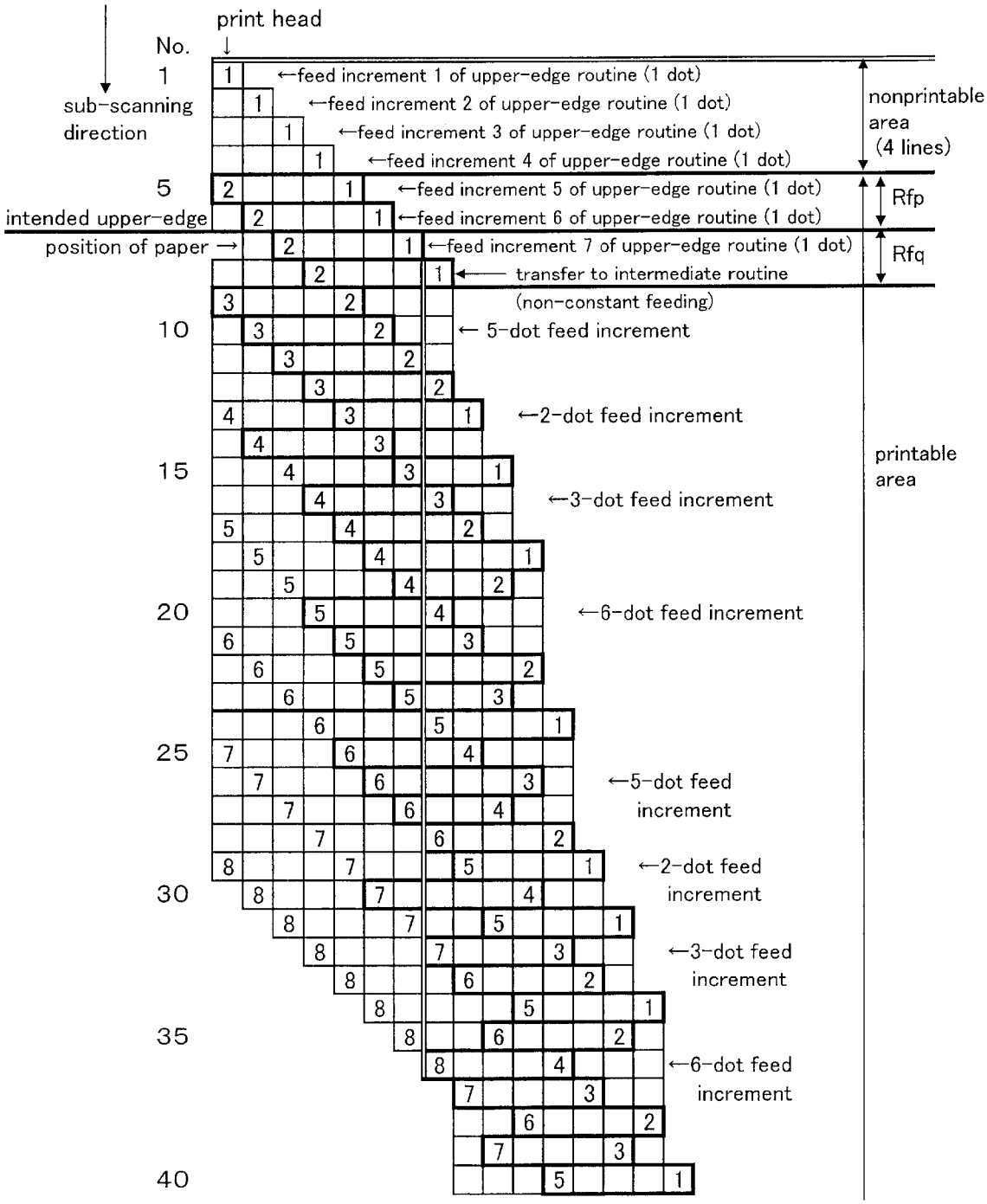
FIG. 17 is a diagram depicting the manner in which raster lines are recorded by particular nozzles in an area near the upper edge (tip) of printing paper.

FIG. 17 is a diagram depicting the manner in which raster lines are recorded by particular nozzles in an area near the upper edge (tip) of printing paper. For the sake of simplicity, the description will be limited to a single row of nozzles. It is assumed that a single row contains eight nozzles. During a main scan, each nozzle is responsible for recording a single raster line. As used herein, the term "raster line" refers to a row of pixels aligned in the main scanning direction. The term "pixel" refers to a single square of an imaginary grid formed on a print medium (and occasionally beyond the edges of the print medium) in order to define the positions at which dots are recorded by the deposition of ink droplets. In the case under consideration, the nozzles are spaced apart at intervals corresponding to three raster lines.

In FIG. 17, a single vertical column of squares represents the print head 28. The numerals 1–8 in each square indicate nozzle numbers. In the present specification, "No." is attached to these numbers to indicate each nozzle. In FIG. 17, the print head 28, which is transported over time in relative fashion in the sub-scanning direction, is shown moving in sequence from left to right. During the upper-edge routine, the single-dot incremental feeding in the sub-scanning direction is repeated seven times, as shown in FIG. 17. As a unit of feed increment in the sub-scanning direction, the term "dot" designates a single-dot pitch corresponding to the printing resolution in the sub-scanning direction, and this dot is also equal to raster line pitch.

The operation then proceeds to the intermediate routine and the 5-, 2-, 3-, and 6-dot feed increments are repeated in the order indicated. The system in which sub-scanning is performed by combining different feed increments in this manner is referred to as "non-constant feeding." Such feeding in the sub-scanning direction allows each raster line (with the exception of some raster lines) to be recorded by two nozzles. In other words, the present embodiment allows each raster line to be printed by two nozzles. In the example shown in FIG. 17, the fifth raster line from the top is recorded by nozzle Nos. 1 and 2. In the process, nozzle No. 2 may, for example, record pixels with even-numbered addresses, and nozzle No. 1 may record pixels with odd-numbered addresses. In addition, the ninth raster line from the top will be recorded by nozzle Nos. 2 and 3. The system in which the pixels within a single raster line are printed by a plurality of nozzles in distributed fashion in this manner will be referred to as "overlap printing." With such overlap printing, the dots of a single raster line are recorded by a plurality of nozzles passing over this raster line during a plurality of main scans for which the positions of printing paper in the sub-scanning direction are mutually different in relation to the print head.

In FIG. 17, the four raster lines from the uppermost tier are such that the nozzle No. 1 makes only one pass per main scan during printing. The result is that pixels cannot be distributed between, and printed by, two nozzles for these raster lines. Consequently, it is assumed with reference to the present embodiment that these four raster lines cannot be used to record images. Specifically, it is assumed with reference to the present embodiment that only the fifth and greater raster lines, as counted from the upstream edge in the sub-scanning direction, can be considered as the raster lines on which the nozzles of the print head 28 can form dots in order to record images. The raster line area in which images can be recorded in this manner is referred to as a printable area. In addition, the raster line area in which image cannot be recorded is referred to as a nonprintable area. In FIG. 17, the numbers attached in order from top to the raster lines in which dots can be recorded by the nozzles of the print head 28 are indicated on the left side of the drawing. The same applies hereinbelow to the drawings illustrating the recording of dots during the upper-edge routine. In the drawings, the nozzles within bold boxes are used for recording dots on raster lines.

In FIG. 17, three or more nozzles pass over the $13^{th}$ to $15^{th}$ raster lines from the top in the course of a main scan during printing. In the raster lines covered by three or more nozzles during printing, dots are recorded only by two of the nozzles involved. For these raster lines, the preferred practice is to record dots as much as possible with the nozzles that pass over the raster lines after the operation has entered the intermediate routine. With the intermediate routine, non-constant feeding is accomplished, and various combinations are created from the nozzles passing over mutually adjacent raster lines, making it possible to expect that the printing operation will yield better image quality than that yielded by the upper-edge routine, which is characterized by constant feeding in single-dot increments.

In the present embodiment, images can be recorded without blank spaces up to the upper edge of the printing paper. As described above, the present embodiment is such that images can be recorded by selecting the fifth and greater raster lines (printable area), as counted from the upstream edge in the sub-scanning direction, from among the raster lines on which dots can be recorded by the nozzles of the print head 28. Consequently, images could theoretically be recorded very close to the upper edge of printing paper by starting dot recording after the printing paper is positioned relative to the print head 28 such that the fifth raster line (as counted from the upper edge) is disposed exactly at the position occupied by the upper edge of the printing paper. There are, however, cases in which the feed increment errors occur during feeding in the sub-scanning direction. There are also cases in which the direction in which ink droplets are ejected shifts away as a result of a manufacturing error or another factor related to the print head. The formation of blank spaces along the upper edge of the printing paper should preferably be prevented in cases in which the position at which the ink droplets are ejected on the printing paper is shifted for these reasons. It is thus assumed with reference to the present embodiment that the image data D used for printing are provided starting from the fifth raster line, which is counted from the upstream edge in the sub-scanning direction and is selected from the raster lines on which dots can be recorded by the nozzles of the print head 28, and that printing is started from a state in which the upper edge of the printing paper P assumes the position occupied by the seventh raster line, as counted from the upstream edge in the sub-scanning direction. Consequently, the prescribed position occupied by the upper edge of the printing paper in relation to each raster line during the start of printing coincides with the position occupied by the seventh raster line, as counted from the upstream edge in the sub-scanning direction (FIG. 17).

Specifically, the present embodiment is such that two raster lines are selected for the width Lfp of the external upper edge portion Rfp (see FIG. 7) of the expanded area R extending beyond the upper edge Pf of the printing paper P outside the printing paper P. Similarly, two raster lines are selected for the width Lrp of the external lower edge portion Rrp (see FIG. 7) of the expanded area R extending beyond the lower edge Pr of the printing paper P outside the printing paper P. The area along the lower edge will be described in detail below.

Figure 18:
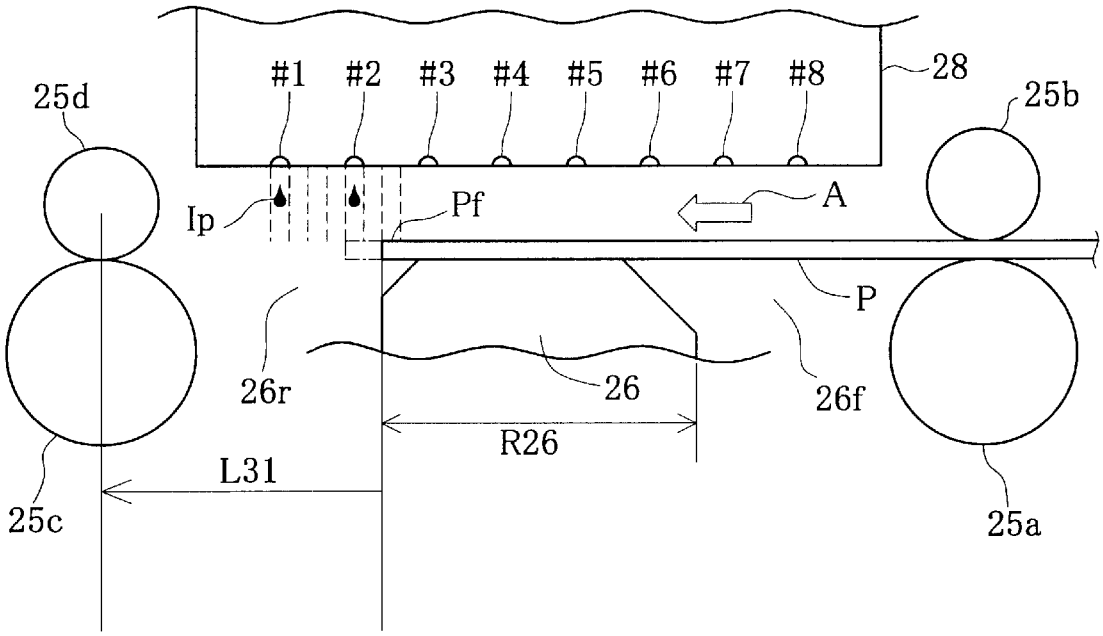
FIG. 18 is a side view depicting the relation between the print head 28 and the printing paper P at the start of printing.

FIG. 18 is a side view depicting the relation between print head 28 and printing paper P at the start of printing. It is assumed herein that the central portion 26*c* of the platen 26 covers the range R26 extending from a rearward position corresponding to two raster lines (as counted from nozzle No. 2 of the print head 28) to a forward position corresponding to two raster lines (as counted from nozzle No. 7). Consequently, the ink droplets from nozzle Nos. 1, 2, 7, and 8 are prevented from depositing on the platen 26 even when the ink droplets Ip are ejected from the nozzles in the absence of printing paper.

In FIG. 6, the nozzles Nr in the hatched portion of the print head 28 correspond to the area in which nozzle Nos. 1 and 2 are disposed. A downstream slot 26*r* is disposed underneath the area over which these nozzles pass during a main scan, and printing is started when the upper edge Pf of the printing paper P reaches the position shown by the dashed line over the downstream slot 26*r*.

As described above, the upper edge Pf of the printing paper P reaches the position of the seventh raster line (as counted from the upstream edge in the sub-scanning direction), which is one of the raster lines on which dots are recorded by the nozzles of the print head 28. Specifically, it follows from FIG. 18 that the upper edge of the printing paper P reaches a rearward position corresponding to six raster lines, as counted from nozzle No. 1. The broken lines in FIG. 18 indicate the prescribed positions of raster lines based on image data. If it is assumed that printing starts at this position, then the raster line belonging to the uppermost tier of the printable area (fifth raster line from the top in FIG. 17) is supposed to be recorded by nozzle No. 2, but the printing paper P has not yet reached the area underneath nozzle No. 2. The result is that accurate feeding of the printing paper P by the upstream paper feed rollers 25*a* and 25*b* will allow the ink droplets Ip ejected by nozzle No. 2 to descend directly into the downstream slot 26*r*. In addition, the raster line belonging to the uppermost tier of the printable area will also be recorded by nozzle No. 1 following four single-dot feed increments, as shown in FIG. 17. Similarly, the printing paper P has not yet reached the area underneath nozzle No. 1 by the time four single-dot feed increments are completed. The result is that the ink droplets Ip ejected from nozzle No. 1 at this time descend directly into the downstream slot 26*r*. The same applies to recording the second raster line from the top of the printable area (sixth raster line from the top in FIG. 17).

There are also cases in which the upper edge of the printing paper P reaches the position occupied by the second raster line from the top of the printable area or by the raster line disposed in the uppermost tier of the printable area if the feed increment of the printing paper P exceeds the designed increment for any reason. The same applies to cases in which the printing paper is tilted and the left or right edge assumes a position downstream (in the sub-scanning direction) of the intended position. In such cases, the present embodiment still allows images to be recorded without blank spaces in the edge portions of the printing paper P because nozzle Nos. 1 and 2 eject ink droplets Ip in these raster lines (in the external upper edge portion Rfp specified for a position beyond the upper edge Pf of the printing paper P). Specifically, blank spaces can be prevented from forming along the upper edge of the printing paper P when the feed increment of the printing paper P exceeds the designed increment but the excessive feed increment is still no more than two raster lines, as shown by the dashed line in FIG. 18. The two-raster line region specified for the area outside the upper edge of the printing paper P is the external upper edge portion Rfp of the image-recording area. In addition, it is the CPU 41 that prints images in the area (expanded area R) beyond the upper edge Pf of the printing paper P in this manner. In other words, it is the CPU 41 that defines the position of the expanded area R in relation to the printing paper P and feeds the printing paper P during sub-scanning while ejecting ink droplets onto the expanded area R. Specifically, the CPU 41 functions as the "edge printing unit".

Another possibility is that the feed increment of the printing paper P falls short of the designed increment for any reason. In such cases the printing paper fails to arrive at the designated position, and the ink droplets Ip end up depositing on the underlying structure. The same applies to cases in which tilting prevents the printing paper P to arrive at the position initially allocated therefor. In the present embodiment, the two raster lines along the intended upper-edge position of the paper sheet are recorded by nozzle Nos. 1 and 2, as shown in FIG. 17. A downstream slot 26*r* is disposed underneath these nozzles, so the ink droplets Ip descend into the downstream slot 26*r* and are absorbed by an absorbent member 27*r* if they fail to deposit on the printing paper P. It is thus possible to prevent situations in which the ink droplets Ip deposit on the upper surface of the platen 26 and subsequently soil the printing paper. Specifically, adopting the present embodiment makes it possible to prevent situations in which the ink droplets Ip deposit on the upper surface of the platen 26 and subsequently soil the printing paper P when the upper edge Pf of the printing paper P moves past the intended position of the upper edge during the start of printing but the deviation of the paper from the intended position of the upper edge is still no more than two raster lines. The two-raster line region in which images are to be recorded by the nozzles above the downstream slot 26*r* inward from the upper edge of the printing paper P is the internal upper edge portion Rfq of the image-recording area.

As described above, it is the CPU 41 that specifies the position of the printing paper P in the sub-scanning direction such that the upper edge Pf of the printing paper P assumes a position above the opening of the downstream slot 26*r* during sub-scanning, and the upper edge Pf assumes a position upstream of the nozzles at the downstream edge in the sub-scanning direction. Specifically, the CPU 41 functions as "a front-edge positioning unit" shown in FIG. 4.

(ii) Lower-edge Routine of First Embodiment

Figure 19:
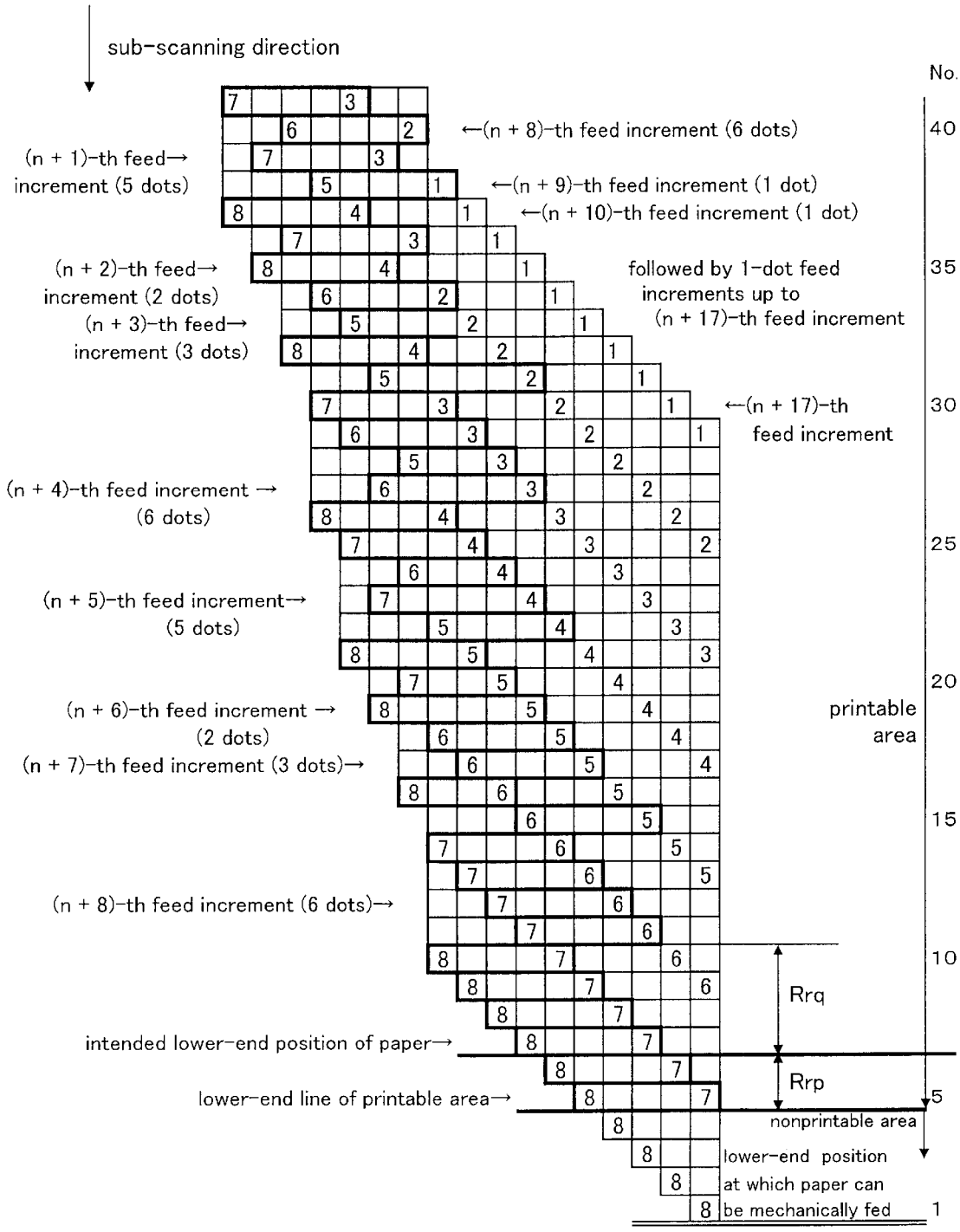
FIG. 19 is a diagram depicting the manner in which raster lines are recorded by particular nozzles during a lower-edge routine.

FIG. 19 is a diagram depicting the manner in which raster lines are recorded by particular nozzles during the lower-edge routine. FIG. 19 depicts the results obtained from the moment an (n+1)-th feed increment is completed in the sub-scanning direction until the moment the final (n+17)-th feed increment is completed in the sub-scanning direction. In the present embodiment, the lower-edge routine entails performing the last nine (that is, from (n+9)-th to (n+17)-th) single-dot feed increments in the sub-scanning direction after 5-, 2-, 3- and 6-dot feed increment are repeatedly performed in sequence in the sub-scanning direction up to the (n+8)-th cycle of the intermediate routine, as shown in FIG. 19. As a result, each of the raster lines (with the exception of some raster lines) aligned in the main scanning direction is recorded by two nozzles. In FIG. 19, the numbers attached in order from the bottom to the raster lines in which dots can be recorded by the nozzles of the print head 28 are indicated on the right side of the drawing. The rest is the same as in the drawings illustrating the recording of dots by the lower-edge routine.

In FIG. 19, the four raster lines from the lowermost tier are such that nozzle No. 8 makes only one pass during printing. The fifth and greater raster lines above the lowermost tier are recorded by two or more nozzles. Consequently, the printable area of the portion occupied by the lower edge of the printing paper extends to the fifth and greater raster lines from the lowermost tier.

In FIG. 19, three or more nozzles pass over the ninth and tenth raster lines from the bottom in the course of a main scan during printing. For the raster lines covered by three or more nozzles during printing, the preferred practice is to record dots as much as possible with the nozzles that pass over the raster lines during an intermediate routine. The printing operation can be expected to yield better image quality than when a lower-edge routine is performed in single-dot constant feed increments.

In the present embodiment, images can be recorded without blank spaces up to the lower edge in the same manner for the upper edge. As described above, the present embodiment is such that images can be recorded by selecting the fifth and greater raster lines (printable area), as counted from the downstream edge in the sub-scanning direction, from among the raster lines that can be used to record dots by the nozzles of the print head 28. It is assumed, however, that images are recorded on the printing paper starting from the seventh raster line (as counted from the downstream edge in the sub-scanning direction) because of considerations related, among other things, to the feed increment errors that occur during feeding in the sub-scanning direction. Specifically, the lower edge of the expanded area R is aligned with the fifth raster line from the downstream edge in the sub-scanning direction, but the lower edge Pr of the printing paper P is aligned with the seventh raster line from the upstream edge in the sub-scanning direction. The two-raster line expanded area R specified for the region beyond the lower edge Pr of the printing paper P is the external lower edge portion Rrp. In the first embodiment, the expanded area R and the printable area coincide because the dots are arranged such that images are formed in all the pixels of the printable area.

Figure 20:
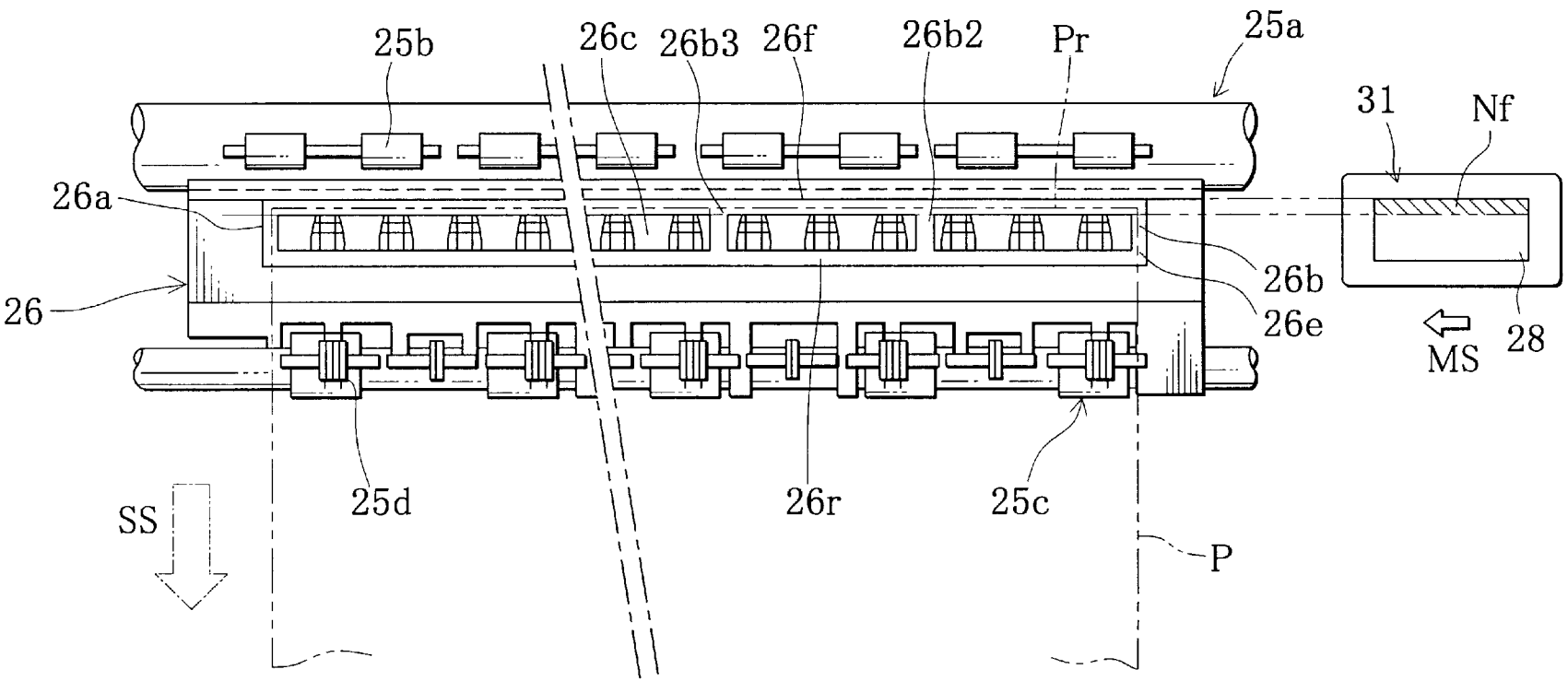
FIG. 20 is a plan view depicting the relation between the printing paper P and an upstream slot 26*f* during printing in the rear-edge portion Pr of the printing paper P.

FIG. 20 is a plan view depicting the relation between the printing paper P and upstream slot 26*f* during printing in the rear-edge portion Pr of the printing paper P. In FIG. 20, the nozzles Nf in the hatched area of the print head 28 correspond to the area in which nozzle Nos. 7 and 8 are located. An upstream slot 26*f* is disposed underneath the area over which these nozzles pass during a main scan, and printing is completed when the lower edge Pr of the printing paper P reaches the position shown by the dashed line above the upstream slot 26*f*.

Figure 21:
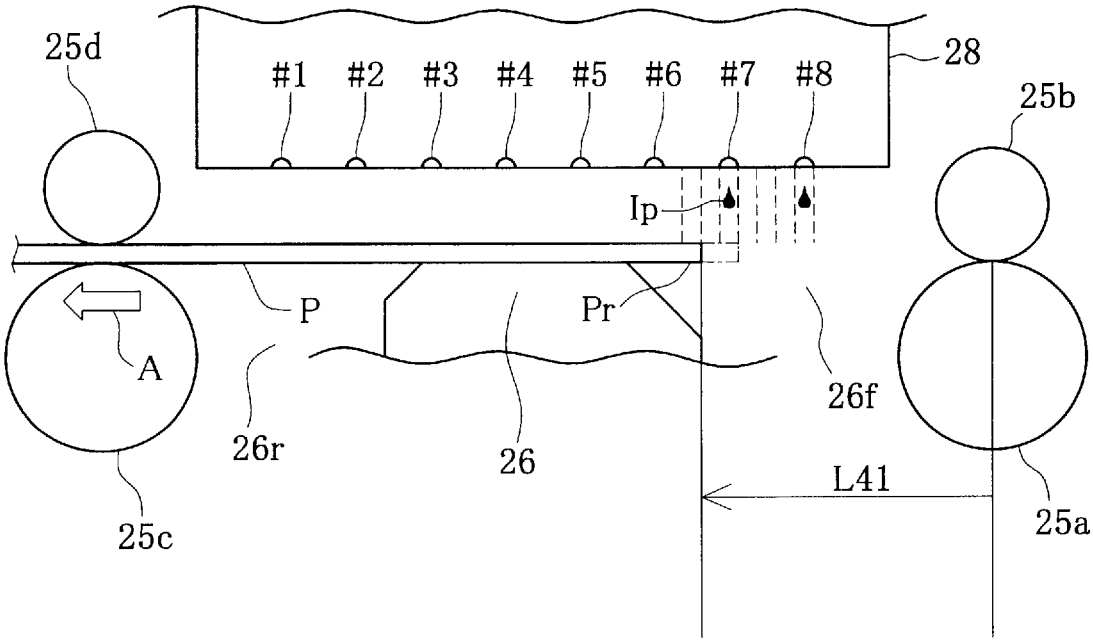
FIG. 21 is a side view depicting the relation between the printing paper P and the print head 28 during printing along the lowermost edge of the printing paper.

FIG. 21 is a side view depicting the relation between the printing paper P, and print head 28 during printing in the rear-edge portion Pr of the printing paper P. When ink droplets are ejected onto the lower edge Pr of the printing paper P, the printing paper P is supported on the platen 26, the lower edge thereof is above the opening of the upstream slot 26*f*, and the printing paper P is arranged such that the lower edge Pr of the printing paper P is at a position (in the sub-scanning direction) downstream of nozzle No. 8. When images are printed in the rear-edge portion Pr of the printing paper P, the lower edge Pr of the printing paper P is disposed at the position occupied by the seventh raster line (as counted from the downstream edge in the sub-scanning direction), which is a raster line on which dots can be recorded by the nozzles of the print head 28, as described above (see FIG. 19). The ink droplets Ip ejected from the nozzle Nos. 7 and 8 will therefore directly descend into the upstream slot 26*f* if it is assumed that dots are recorded in the lowermost tier of the printable area (the expanded area R) and on the second raster line from the lowermost tier (sixth and fifth raster lines from bottom in FIG. 19) after recording of the lowermost raster line in the printing paper P.

If the distance over which the printing paper P is fed falls short of the intended distance for any reason (the dashed line in FIG. 11), images can still be recorded without blank spaces along the lower edge Pr of the printing paper P because nozzle Nos. 7 and 8 eject ink droplets Ip along the fifth and sixth raster lines from the bottom (at positions beyond the lower edge Pr of the printing paper P). The same applies to cases (shown by the dashed line in FIG. 10) in which the printing paper is tilted and the left or right edge thereof assumes a position upstream (in the sub-scanning direction) of the intended position. Specifically, blank spaces can be prevented from forming along the lower edge of the printing paper P if such insufficient feeding or positional shifting does not exceed two raster lines, as shown by the dashed line in FIG. 21. The two-raster line region specified for the area outside the lower edge of the printing paper is the external lower edge portion Rrp of the image-recording area. In addition, it is the CPU 41 that prints images in the area (expanded area R) beyond the lower edge Pr of the printing paper P in this manner. Specifically, the CPU 41 functions as an edge printing unit.

The four raster lines (seventh to tenth raster lines from bottom in FIG. 19) along the intended upper-edge position of the paper sheet are recorded by nozzle Nos. 7 and 8. It is therefore possible to prevent situations in which the ejected ink droplets Ip fall into the upstream slot 26*f* and deposit in the area occupied by the upper surface of the platen 26 when the feed increment of the printing paper P falls below the designed increment for any reason(the dashed line in FIG. 11). The same applies to cases (shown by the two-dot chain line in FIG. 10) in which the printing paper is tilted and the left or right edge thereof assumes a position downstream (in the sub-scanning direction) of the intended position. The four-raster line region in which images are to be recorded by the nozzles above the upstream slot 26*f* inward from the lower edge of the printing paper P is the internal lower edge portion Rrq of the image-recording area.

As described above, it is the CPU 41 that specifies the position of the printing paper P in the sub-scanning direction such that the lower edge Pr of the printing paper P assumes a position above the opening of the upstream slot 26*f* during sub-scanning, and the lower edge Pr assumes a position downstream of the nozzles at the upstream edge in the sub-scanning direction. Specifically, the CPU 41 functions as "a rear-edge positioning unit" shown in FIG. 4.

(iii) Printing in Left and Right Edge Portions

Figure 22:
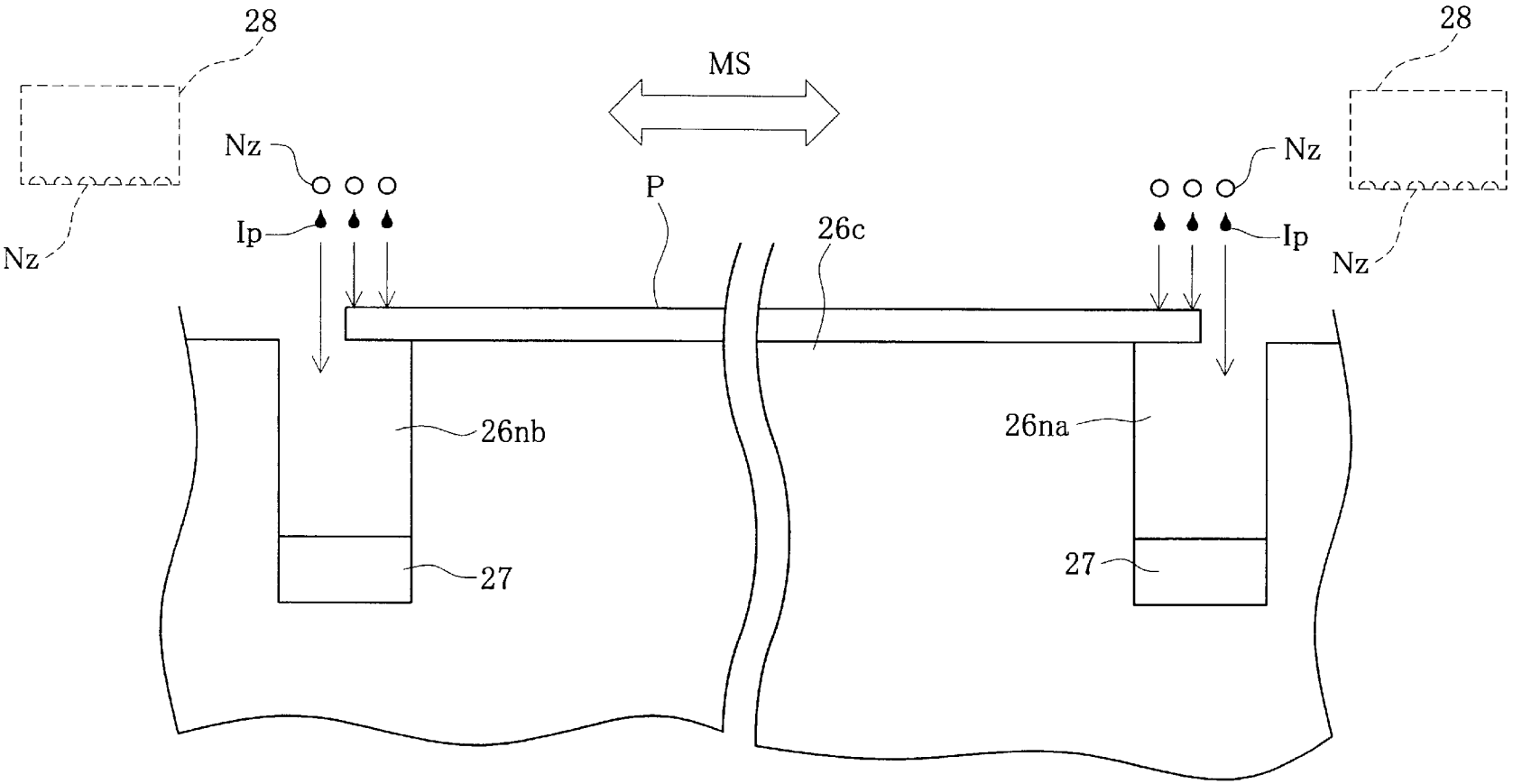
FIG. 22 is a diagram depicting the manner in which images are printed in the left and right side-edge portions of the printing paper P.

FIG. 22 is a diagram showing the manner in which images are printed in the left and right edge portions of a printing paper P. In the present embodiment, images are printed without blank spaces in the left and right edge portions of the printing paper P throughout the entire procedure in which images are recorded on the printing paper P, including upper- and lower-edge routines. In the process, the print head 28 is advanced during a main scan such that all its nozzles first move past one of the edges of the printing paper P and reach a position outside the printing paper P, and then move past the other edge of the printing paper P and reach a position outside the printing paper P. Ink droplets are ejected onto the expanded area R in accordance with image data D not only when the nozzles Nz are disposed above the printing paper P but also when the nozzles Nz move past the edges of the printing paper P and reach the area above the left slot 26*a* or right slot 26*b*. Here, the width Wr of the expanded area R as an image-recording area is greater than the width of the printing paper P between the left and right edges but is no more than the distance between the side walls of the exterior portions of the couple of lateral slots described below. Consequently, ejecting ink droplets from the nozzles Nz in accordance with the image data D allows these ink droplets to be ejected when the nozzles Nz are disposed beyond the edges of the printing paper P and when these nozzles are disposed above the left slot 26*a* or right slot 26*b*.

Performing printing in this manner allows images to be formed without blank spaces along the left and right edges of the printing paper P even when the printing paper P shifts somewhat in the main scanning direction. Because the nozzles positioned above the left slot 26*a* or right slot 26*b* are designed for printing images in the two edge portions of the printing paper, ink droplets are allowed to deposit in the left slot 26*a* or right slot 26*b* without depositing in the central portion 26*c* of the platen 26 when the ink droplets miss the printing paper P. It is therefore possible to prevent the printing paper P from being soiled by the ink droplets deposited in the central portion 26*c* of the platen 26.

The above description was given with reference to a case in which the printing paper that could be used with the printer 22 was a printing paper having maximum width in the sub-scanning direction, but the same reasoning can be applied to narrower printing paper. Specifically, the guides 29*a* and 29*b* (see FIG. 6) are arranged such that the left and right edge portions of the narrower printing paper are disposed above the left slot 26*a* and right slot 26*b*2 or above the left slot 26*a* and right slot 26*b*3. Ink droplets are ejected not only when the nozzles Nz are disposed above the printing paper P but also when the nozzles move past the edges of the printing paper P and reach the area above the left slot 26*a*, right slot 26*b*2, or right slot 26*b*3.

C. Modifications

The present invention is not limited by the above-described embodiments or embodiments and can be implemented in a variety of ways as long as the essence thereof is not compromised. For example, the following modifications are possible.

C1. Modification 1

It was assumed in the first embodiment that the width Wr of the expanded area R could be calculated by adding constant widths Wa and Wb to the width Wp of the print medium irrespective of the type of print medium. It is also possible, however, to adopt an approach in which the width of the portion of the expanded area extending beyond the right and left edges of the print medium is selected in accordance with the type of printing paper. As in the case shown in FIG. 10, the extent to which the left and right edges of the printing paper shift their positions when the printing paper tilts away from the intended configuration is proportional to the tilt angle and the dimensions of the medium in the sub-scanning direction. The probability that blank spaces will be formed in the left and right edge portions or that ink droplets will deposit on the platen when the printing paper is tilted can thus be reduced by adopting an approach in which the width of the portion of the expanded area extending beyond the left and right edges of the print medium is selected in accordance with the type of printing paper.

C2. Modification 2

Plain paper, photoprint paper, special glossy film, special OHP sheets, and the like were mentioned as the print media in the first embodiment, but the print media is not limited to these materials alone. It is possible, for example, to use fabric or a medium having certain rigidity, such as CD-R. The shape of the print medium is not limited to the rectangular shape alone and may include a circular shape such as that of a CD-R.

In this case, the slots on the platen should match the shape of each type of print medium, and the number of pixels in the raster lines constituting the expanded area should preferably match the shape of the print medium. Any print medium can be used as long as it allows images to be recorded using dot-forming elements.

C3. Modification 3

In the first embodiment, a single left slot was provided, and a plurality of right slots were provided in accordance with the width of the print medium (see FIGS. 5 and 16). Dots were formed such that the print medium was transported irrespective of its width such that one lateral slot was brought to a position above the left slot. It is possible, however, to provide a single slot on the right and to provide a plurality of left slots in accordance with the width of the print medium. Another option is to provide a plurality of sets of left and right slots in accordance with the width of the print medium. In other words, a plurality of lateral slots separated apart at a distance substantially equal to the width of the print medium can be provided in accordance with the width of the print medium that can be accommodated by the printing device, and these lateral slots can be configured in a variety of ways.

C4. Modification 4

In the first embodiment, the upstream slot 26*f* was disposed opposite some of the upstream nozzles Nf (see FIG. 20), which included the most upstream nozzles of the print head 28. The downstream slot 26*r* was disposed opposite some of the downstream nozzles Nr (see FIG. 6), which included the most downstream nozzles Nz of the print head 28. The relation between the nozzles and slots is not limited by this arrangement, however. It is possible, for example, to place a group of nozzles further upstream of the upstream slot 26*f* and to place an upstream platen support opposite this group of nozzles. Adopting this arrangement makes it less likely that the front edge (upper edge) of a print medium arriving from the upstream side will fall down into the upstream slot. Similarly, a group of nozzles can be provided further downstream of the downstream slot 26*r*, and a downstream platen support can be placed opposite this group of nozzles.

Figure 23:
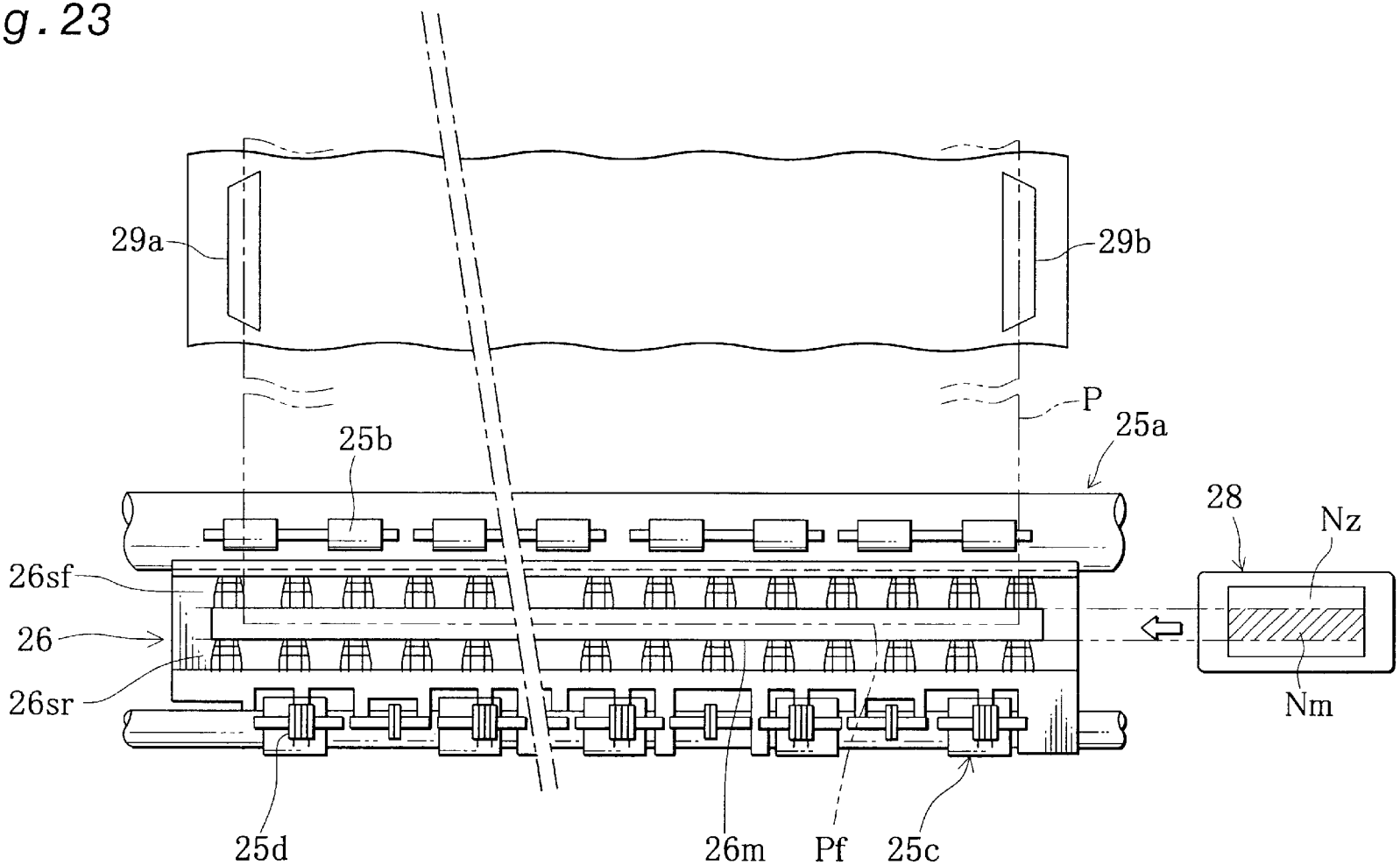
FIG. 23 is a plan view depicting the relation between the slot 26*m* and the printing paper P during the printing of images along the upper edge Pf of the printing paper P with a modified printing device.
Figure 24:
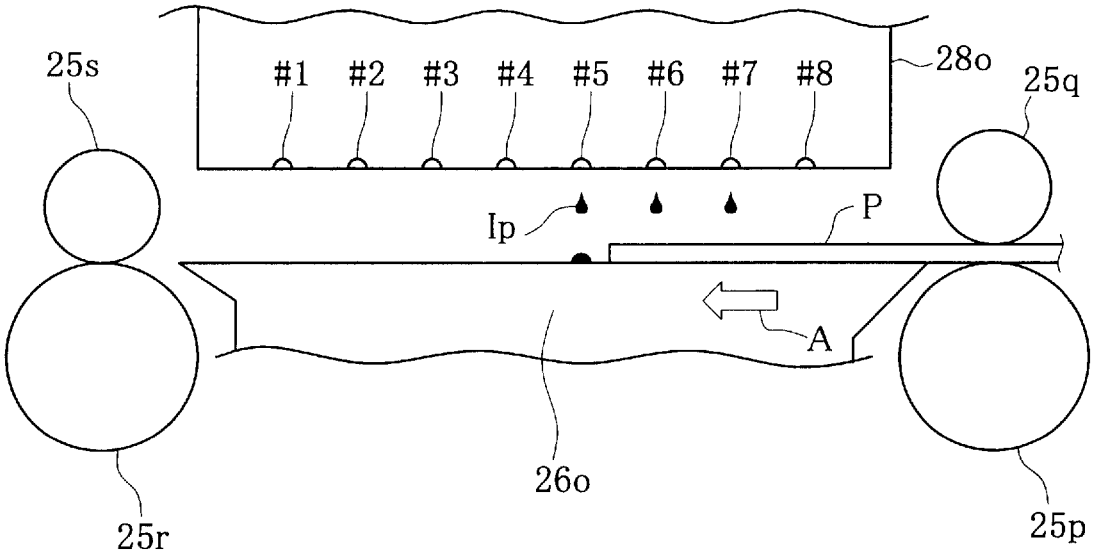
FIG. 24 is a side view depicting the periphery of a print head for a conventional printer.

FIG. 23 is a plan view depicting the relation between the printing paper P and a slot 26*m* during the printing of images along the upper edge Pf of the printing paper P with a modified printing device. The first embodiment was described with reference to a case in which the platen slots consisted of an upstream slot 26*f* and a downstream slot 26*r*, the images in the front-edge portion of the printing paper P were printed with the nozzles Nr disposed opposite the downstream slot 26*r*, and the images in the rear-edge portion of the printing paper P were printed with the nozzles Nf disposed opposite the upstream slot 26*f*. However, the platen slots are not limited by this configuration, and embodiments in which the platen is provided with a single slot are also acceptable. In such embodiments, the images in the lower- and front-edge portions of the printing paper P are printed with nozzles Nm that are disposed opposite the single slot 26*m* provided to the platen. Such embodiments make it easier for an upstream support 26*sf* and downstream support 26*sr* provided on the upstream and downstream sides of the slot to be set apart at a considerable distance in the sub-scanning direction.

C5. Modification 5

The first embodiment involved performing constant feeding in 1-dot increments, in accordance with upper- and lower-edge routines. However, the feeding method of the upper- and lower-edge routines is not limited thereby and may include constant feeding in 2-, 4-, or 5-dot increments, depending on the nozzle pitch or the number of nozzles in a nozzle row. In other words, any feeding method may be adopted as long as the maximum feed increment in the sub-scanning direction is less than the maximum feed increment in the sub-scanning direction for the intermediate routine. In should be noted that adopting smaller feed increments in the sub-scanning direction for the upper-edge routine allows the upper edge of printing paper to be recorded with the nozzles disposed further downstream in the sub-scanning direction. The downstream slot can therefore be narrowed, and the upper platen surface for supporting the printing paper can be broadened. Similarly, adopting smaller feed increments in the sub-scanning direction for the lower-edge routine allows the upper edge of printing paper to be recorded with the nozzles disposed further upstream in the sub-scanning direction. The upstream slot can therefore be narrowed, and the upper platen surface for supporting the printing paper can be broadened.

Neither is the feeding method of the intermediate routine limited to an non-constant feeding arrangement in which the system is repeatedly fed in 5-, 2-, 3-, and 6-dot increments in the order indicated. For example, feeding the system in 5-, 3-, 2-, and 6-dot increments may be adopted for the structure described in the first embodiment. Depending on the number of nozzles, the nozzle pitch, or the like, combinations of other feed increments may be adopted, or constant feeding methods involving other feed increments carried out. In other words, any type of secondary scan feeding may be adopted as long as the maximum feed increment in the sub-scanning direction is less than the maximum feed increment in the sub-scanning direction for the upper or lower-edge routine.

C6. Modification 6

Although the above embodiments were described with reference to cases in which both the upper- and lower-edge routine were carried out, it is also possible to perform only one of these routines as needed. In addition, the printing devices of the present embodiments were configured such that the platen 26 was provided with an upstream slot 26*f* and a downstream slot 26*r* on the upstream side and downstream sides, respectively, in the sub-scanning direction, although providing only one of them is also acceptable.

Although the above embodiments were described with reference to cases in which images were printed without blank spaces along the left and right edges of a printing paper P, it is also possible to adopt an arrangement in which images are printed only on one side as needed.

C7. Modification 7

The present invention can be adapted to monochromatic printing in addition to color printing. The use of the present invention is not limited to ink-jet printers alone and commonly includes all dot-recording devices in which images are recorded on the surface of a print medium by a print head having a plurality of dot-forming element arrays. As used herein, the term "dot-forming element" refers to a dot-forming constituent element such as an ink nozzle of an ink-jet printer.

C8. Modification 8

Figure 25:
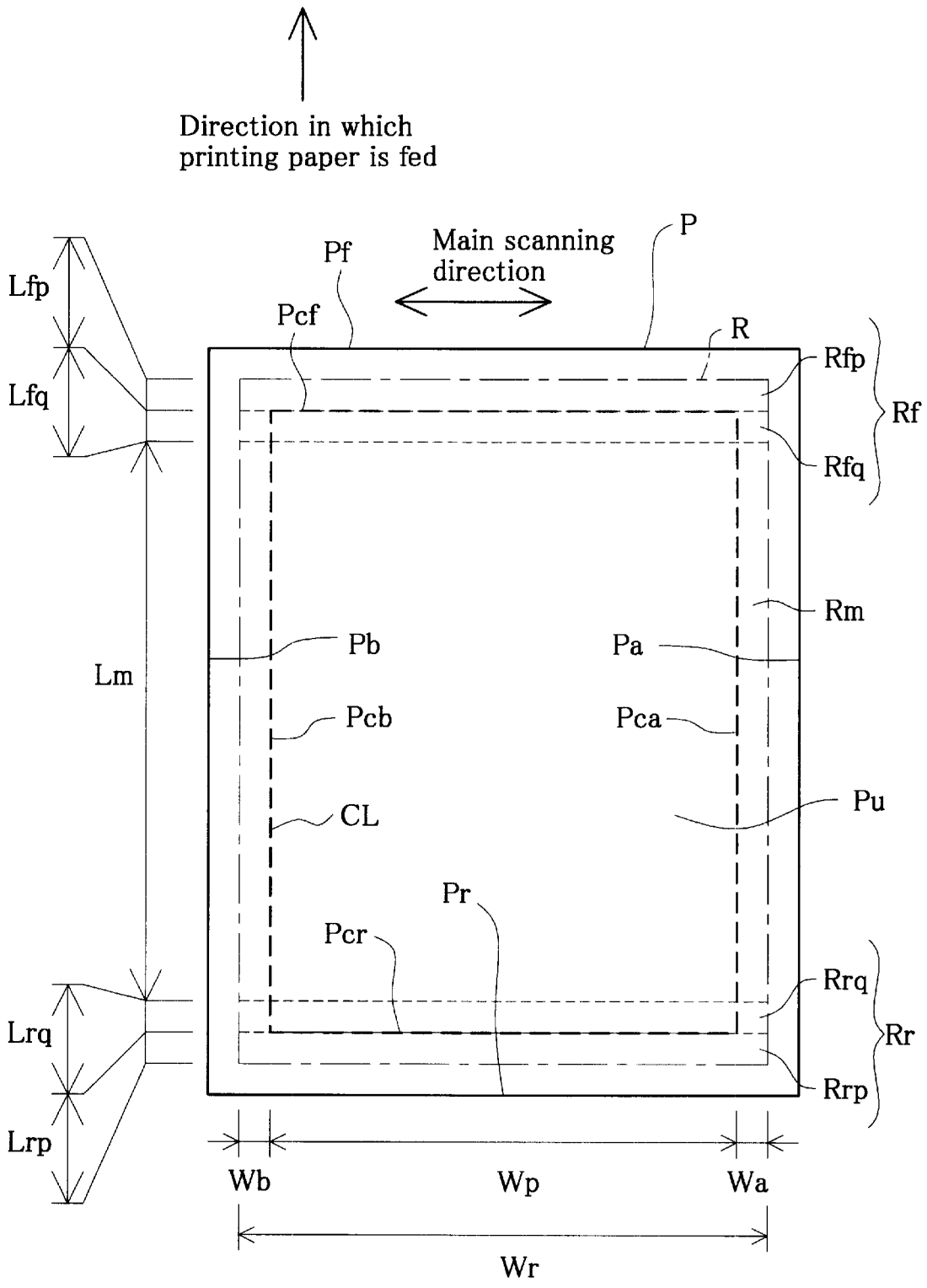
FIG. 25 is an explanatory drawing depicting the relationship between image printing area R and printing paper P.

FIG. 25 is an explanatory drawing depicting the relationship between image printing area R and printing paper P. The printing paper shown in modification 8 has a usable area Pu enclosed by perforation CL. Usable area Pu can be easily separated from other areas of printing paper P along the perforation CL without using scissors or other implements. In modification 8, the printing area R of the image extends beyond the top edge Pcf of the usable area Pu. Similarly, an extended area R can be established beyond the bottom edge Pcr, left edge Pca, or right edge Pcb of the usable area Pu.

The extended area R has a size and shape such that it lies within the printing paper P, that is, the extended area R does not extend beyond the edges of the printing paper P. In modification 8, the shape of the extended area R is rectangular, and its dimensions are defined as follows. The width Wr of the extended area is greater than the horizontal width of the usable area Pu but less than the horizontal width of the printing paper P. Furthermore, the length Lr of the extended area R in the direction of printing paper feeding is greater than the vertical length of the usable area Pu but less than the length of the printing paper P in the direction of printer paper feeding. With this arrangement, printing can be accomplished without staining the platen 26 and without leaving any margin up to the edge of the usable area.

As in the case of the first embodiment shown in FIG. 7, the dimensions of the portion of extended area R in the direction of main scanning, that extend beyond the left and right edges Pca, Pcb of the printing paper P (that is, external left and right edge portion Rap and Rbp) depend on the dimension of the usable area Pu in the main scanning direction. The widths Wa, Wb of the left and right outer strips Rap, Rbp are equal but may also have different dimensions. With this arrangement, printing can be accomplished without dirtying the platen 26 and without leaving any margin up to the edge of the usable area.

The dimensions of the portion of extended area R in the direction of printing paper feeding, that extend beyond the top and bottom edges Pcf, Pcr of the printing paper P (i.e., extended upper and lower edge portions Rfp and Rrp) depend on the dimension of the usable area Pu in the direction of printing paper feeding and on the material comprising the printing paper P. With this arrangement, the dimensions, in the direction of printing paper feeding, of the extended upper and lower edge portions Rfp and Rrp can be defined according to the slipperiness and cumulative error of the printing paper during paper feeding.

As in the case of the first embodiment, when the sizes of the extended upper and lower edge portions Rfp and Rrp are defined by the number of main scan lines, and when the printing device used has two or more printing modes of differing dot printing resolution in the direction of printing paper feeding, it is preferable thet the number of main scan lines that define the extended upper and lower edge portions Rfp and Rrp is specified according to the printing mode. In such cases, it is preferable that the number of main scanning lines for a given type of printing medium are specified so that the extended upper and lower edge portions Rfp and Rrp in each printing mode have equal size.

C9. Modification 9

In the above embodiments, software can be used to perform some of the functions carried out by hardware, or, conversely, hardware can be used to perform some of the functions carried out by software. For example, a host computer 90 can be used to perform some of the functions carried out by the CPU 41 (FIG. 6).

The computer programs for performing such functions may be supplied as programs stored on floppy disks, CD-ROMs, and other types of computer-readable recording media. The host computer 90 may read the computer programs from these recording media and transfer the data to internal or external storage devices. Alternatively, the computer programs can be installed on the host computer 90 from a program-supplying device via a communications line. Computer programs stored by an internal storage device are executed by the host computer 90 when the functions of the computer programs are to be performed. Alternatively, computer programs stored on a storage medium may be executed directly by the host computer 90.

As used herein, the term "host computer 90" refers both to a hardware device and to an operating system, and designates a hardware device capable of operating under the control of an operating system. Computer programs allow such a host computer 90 to perform the functions of the above-described units. Some of the aforementioned functions can be performed by an operating system rather than an application program.

As used herein, the term "computer-readable recording medium" is not limited to a portable recording medium such as a floppy disk or a CD-ROM and includes various RAMs, ROMs, and other internal computer storage devices as well as hard disks and other external storage devices fixed to the computer.

Although the present invention has been described and illustrated in detail, it is clearly understood that the same is by way of illustration and example only and is not to be taken by way of limitation, the spirit and scope of the present invention being limited only by the terms of the appended claims.

I claim:

1. A dot-recording method using a dot-recording device for recording ink dots on a surface of a print medium, the dot-recording device including a dot-recording head having a plurality of dot-forming elements for ejecting ink droplets and a platen configured to extend in the main scanning direction and to be disposed opposite the dot-forming elements at least along part of a main scan path, the platen having a slot configured to extend in the main scanning direction, a width of the slot in the sub-scanning direction corresponding to a specific sub-scanning range on a surface of the dot recording head including at least part of the plurality of dot-forming elements, the dot-recording method comprises the steps of:

(A) setting an expanded area in accordance with a type of print medium to be used in the dot recording, the expanded area extending lengthwise beyond at least front and rear edges of the print medium, and representing a recording area in which images are to be recorded on the print medium;

(B) preparing print data for recording images in the expanded area; and (C) performing edge printing by ejecting ink droplets from at least some of the dot-forming elements disposed opposite the slot when images are printed at least in front- or rear-edge portions of the print medium on the basis of the print data;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

2. A dot-recording method as defined in claim 1, wherein a relatively large expanded area in the sub-scanning direction is set to a print medium that is included in a type of print medium with a specific slipperiness and a relatively large dimension in the sub-scanning direction, and a relatively small expanded area in the sub-scanning direction is set to a print medium that is included in the type of print medium with the specific slipperiness and a relatively small dimension in the sub-scanning direction.

3. A dot-recording method as defined in claim 1, wherein the step (C) comprises the steps of:

(C1) when ink droplets are ejected onto the front edge of the print medium, positioning the print medium in the sub-scanning direction such that
the print medium is supported on the platen, the front edge of the print medium is brought to a point above the slot, and the front edge of the print medium reaches a point located in the sub-scanning direction upstream of a dot-forming element at a downstream end in the sub-scanning direction; and (C2) when ink droplets are ejected onto the rear edge of the print medium, positioning the print medium in the sub-scanning direction is selected such that the print medium is supported on the platen, the rear edge of the print medium is brought to a point above the slot, and the rear edge of the print medium reaches a point located in the sub-scanning direction downstream of a dot-forming element at an upstream end in the sub-scanning direction.

4. A dot-recording method as defined in claim 1, wherein the step (B) comprises the step of:

preparing print data containing information about recording condition of dots at pixels inside the expanded area.

5. A dot-recording method using a dot-recording device for recording ink dots on a surface of a print medium, the dot-recording device including a dot-recording head having a plurality of dot-forming elements for ejecting ink droplets and a platen configured to extend in the main scanning direction and to be disposed opposite the dot-forming elements at least along part of a main scan path, the platen having a slot configured to extend in the main scanning direction, a width of the slot in the sub-scanning direction corresponding to a specific sub-scanning range on a surface of the dot recording head including at least part of the plurality of dot-forming elements, the dot-recording method comprises the steps of:

(A) setting an expanded area in accordance with a type of print medium to be used in the dot recording, the expanded area extending lengthwise beyond at least front and rear edges of the print medium, and representing a recording area in which images are to be recorded on the print medium;

(B) preparing print data for recording images in the expanded area; and (C) performing edge printing by ejecting ink droplets from at least some of the dot-forming elements disposed opposite the slot when images are printed at least in front- or rear-edge portions of the print medium on the basis of the print data; and wherein the platen further has a pair of lateral slots separated apart at a distance substantially equal to a width of the print medium, the lateral slots extending in a sub-scanning range in which ink droplets are ejected from the plurality of dot-forming elements, each lateral slot having side walls extending in the sub-scanning direction; and wherein the expanded area extends widthwise beyond left and right edges of the print medium but remaining between farthermost side walls of the pair of lateral slots.

6. A dot-recording method as defined in claim 5, further comprising the steps of:

(D) positioning the print medium in the main scanning direction such that the print medium is supported on the platen, and the left and right edges of the print medium are brought to a point above the lateral slots; and (E) forming dots on the basis of image data representing an image extending outside the print medium beyond the left and right edges.

7. A dot-recording method using a dot-recording device for recording ink dots on a surface of a print medium, the dot-recording device including a dot-recording head having a plurality of dot-forming elements for ejecting ink droplets and a platen configured to extend in the main scanning direction and to be disposed opposite the dot-forming elements at least along part of a main scan path, the platen having a slot configured to extend in the main scanning direction, a width of the slot in the sub-scanning direction corresponding to a specific sub-scanning range on a surface of the dot recording head including at least part of the plurality of dot-forming elements, the dot-recording method comprises the steps of:

(A) setting an expanded area in accordance with a type of print medium to be used in the dot recording, the expanded area extending lengthwise beyond at least front and rear edges of the print medium, and representing a recording area in which images are to be recorded on the print medium;

(B) preparing print data for recording images in the expanded area;

(C) performing edge printing by ejecting ink droplets from at least some of the dot-forming elements disposed opposite the slot when images are printed at least in front- or rear-edge portions of the print medium on the basis of the print data; and (D) selecting a specific print mode from among a plurality of available print modes, wherein the type of the print medium depends on slipperiness of the print medium, and wherein the step(B) comprises the step of, (B1) preparing the print data in accordance with the selected print mode.

8. A dot-recording method as defined in claim 7, wherein the plurality of available print modes include print modes with mutually different sub-scan resolutions, the sub-scan resolution representing a recording density of raster lines in the sub-scanning direction; and wherein the step (B) comprises the step of:

(B2) setting a number of raster lines constituting the expanded area in accordance with the selected print mode.

9. A dot-recording method as defined in claim 8, wherein the step (C) comprises the step of printing images using solely the dot-forming elements disposed opposite the slot.

10. A dot-recording method as defined in claim 8, wherein the step (C1) comprises the steps of:

(C2) when ink droplets are ejected onto the front edge of the print medium, positioning the print medium in the sub-scanning direction such that the print medium is supported on the platen, the front edge of the print medium is brought to a point above the slot, and the front edge of the print medium reaches a point located in the sub-scanning direction upstream of a dot-forming element at a downstream end in the sub-scanning direction; and (C3) when ink droplets are ejected onto the rear edge of the print medium, positioning the print medium in the sub-scanning direction such that the print medium is supported on the platen, the rear edge of the print medium is brought to a point above the slot, and the rear edge of the print medium reaches a point located in the sub-scanning direction downstream of a dot-forming element at an upstream end in the sub-scanning direction.

11. A dot-recording method using a dot-recording device for recording ink dots on a surface of a print medium, the dot-recording device including a dot-recording head having a plurality of dot-forming elements for ejecting ink droplets and a platen configured to extend in the main scanning direction and to be disposed opposite the dot-forming elements at least along part of a main scan path, the platen having a slot configured to extend in the main scanning direction, a width of the slot in the sub-scanning direction corresponding to a specific sub-scanning range on a surface of the dot recording head including at least part of the plurality of dot-forming elements, the dot-recording method comprises the steps of:

(A) setting an expanded area in accordance with a type of print medium to be used in the dot recording, the expanded area extending lengthwise beyond at least front and rear edges of the print medium, and representing a recording area in which images are to be recorded on the print medium;

(B) preparing print data for recording images in the expanded area;

(C) performing edge printing by ejecting ink droplets from at least some of the dot-forming elements disposed opposite the slot when images are printed at least in front- or rear-edge portions of the print medium on the basis of the print data;

(D) selecting a specific print mode from among a plurality of available print modes, (E) dividing the expanded area, in order from the top, into:

an external front edge portion disposed in an area beyond the front edge of the print medium and configured such that formation of dots in this portion is assigned to the dot-forming elements disposed opposite the slot;

an internal front edge portion on the front-edge portion of the print medium and configured such that formation of dots in this portion is assigned to the dot-forming elements disposed opposite the slot;

an intermediate portion of the print medium;

an internal rear edge portion on the rear-edge portion of the print medium and configured such that formation of dots in this portion is assigned to the dot-forming elements disposed opposite the slot; and an external rear edge portion disposed in an area beyond the rear edge of the print medium and configured such that formation of dots in this portion is assigned to the dot-forming elements disposed opposite the slot, wherein the step(B) comprises the steps of, (B1) preparing the print data in accordance with he selected print mode; and (B2) setting a number of raster lines constituting the expanded area in accordance with the selected print mode;

wherein the plurality of available print modes include print modes with mutually different sub-scan resolutions, the sub-scan resolution representing a recording density of raster lines in the sub-scanning direction; and wherein the step (B2) comprises the steps of:

(B3) setting a number of raster lines for the external front edge portion according to the selected print mode such that dimensions of the external front edge portion remain the same in the sub-scanning direction with respect to different print modes having mutually different sub-scan resolutions, when the same type of print medium is used; and (B4) setting a number of raster lines for the external rear edge portion such that the dimensions of the external rear edge portion remain the same in the sub-scanning direction with respect to different print modes having mutually different sub-scan resolutions, when the same type of print medium is used.

12. A dot-recording method as defined in claim 11, wherein the step (B2) further comprises the steps of:

(B5) setting a number of raster lines for the internal front edge portion such that the dimensions of the internal front edge portion remain the same in the sub-scanning direction with respect to different print modes having mutually different sub-scan resolutions, when the same type of print medium is used; and (B6) setting a number of raster lines for the internal rear edge portion such that the dimensions of the internal rear edge portion remain the same in the sub-scanning direction with respect to different print modes having mutually different sub-scan resolutions, when the same type of print medium is used.

13. A dot-recording method using a dot-recording device for recording ink dots on a surface of a print medium, the dot-recording device including a dot-recording head having a plurality of dot-forming elements for ejecting ink droplets and a platen configured to extend in the main scanning direction and to be disposed opposite the dot-forming elements at least along part of a main scan path, the platen having a slot configured to extend in the main scanning direction, a width of the slot in the sub-scanning direction corresponding to a specific sub-scanning range on a surface of the dot recording head including at least part of the plurality of dot-forming elements, the dot-recording method comprises the steps of:

(A) setting an expanded area in accordance with a type of print medium to be used in the dot recording, the expanded area extending lengthwise beyond at least front and rear edges of the print medium, and representing a recording area in which images are to be recorded on the print medium;

(B) preparing print data for recording images in the expanded area;

(C) performing edge printing by ejecting ink droplets from at least some of the dot-forming elements disposed opposite the slot when images are printed at least in front- or rear-edge portions of the print medium on the basis of the print data; and (D) selecting a specific print mode from among a plurality of available print modes, and wherein the step(B) comprises the step of, (B2) preparing the print data in accordance with he selected print mode, wherein the plurality of print modes include print modes having mutually different recording densities for the pixels in the main scanning direction;

wherein the platen further has a pair of lateral slots separated apart at a distance substantially equal to a width of the print medium, the lateral slots extending in a sub-scanning range in which ink droplets are ejected from the plurality of dot-forming elements; and wherein the step (B1) comprises the step of:

(B2) setting the dimensions of the expanded area such that the expanded area extends widthwise beyond left and right edges of the print medium but remains between farthermost side walls of the pair of lateral slots, and setting the number of pixels in the main scanning direction for the raster lines constituting the expanded area is specified substantially in accordance with the print mode thus selected.

14. A dot-recording method as defined in claim 13, wherein the step (C) comprises the step of:

(C2) positioning the print medium in the sub-scanning direction such that the print medium is supported on the platen, and the left and right edges of the print medium are brought to a point above the lateral slots; and (C3) forming dots on the basis of image data representing an image extending outside the print medium beyond the left and right edges.

15. A dot-recording control device for generating print data to be sent to a dot-recording unit for recording dots on a surface of a print medium with the aid of a dot-recording head provided with a plurality of dot-forming elements for ejecting ink droplets, wherein the dot-recording unit is configured to drive the dot-recording head and/or the print medium to perform main scanning, to drive at least some of the dot-forming elements to form dots, and to cause the print medium to perform sub-scanning by being driven across the main scanning direction in between the main scans, and comprises a platen configured to extend in the main scanning direction and to be disposed opposite the dot-forming elements at least along part of a main scan path, and having a slot configured to extend in the main scanning direction, a width of the slot in the sub-scanning direction corresponding to a specific sub-scanning range on a surface of the dot recording head including at least part of the plurality of dot-forming elements, the dot-recording control device comprises an image data generator configured to generate image data for the images recorded on the print medium;

an area size memory configured to store information about an expanded area in accordance with a type of print medium to be used in the dot recording, the expanded area extending lengthwise beyond at least front and rear edges of the print medium and representing a recording area in which images are to be recorded on the print medium;

an input unit by which information about a selected type of print medium is entered; and a print data generator configured to generate the print data representing images in the expanded area on the basis of information about the selected type of print medium, information about the expanded area, and the image data;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

16. A dot-recording control device as defined in claim 15, wherein the area size memory stores information about the expanded area in accordance with dimensions of the selected type of print medium.

17. A dot-recording control device for generating print data to be sent to a dot-recording unit for recording dots on a surface of a print medium with the aid of a dot-recording head provided with a plurality of dot-forming elements for ejecting ink droplets, wherein the dot-recording unit is configured to drive the dot-recording head and/or the print medium to perform main scanning, to drive at least some of the dot-forming elements to form dots, and to cause the print medium to perform sub-scanning by being driven across the main scanning direction in between the main scans, and comprises a platen configured to extend in the main scanning direction and to be disposed opposite the dot-forming elements at least along part of a main scan path, and having a slot configured to extend in the main scanning direction, a width of the slot in the sub-scanning direction corresponding to a specific sub-scanning range on a surface of the dot recording head including at least part of the plurality of dot-forming elements, the dot-recording control device comprises an image data generator configured to generate image data for the images recorded on the print medium;

an area size memory configured to store information about an expanded area in accordance with a type of print medium to be used in the dot recording, the expanded area extending lengthwise beyond at least front and rear edges of the print medium and representing a recording area in which images are to be recorded on the print medium;

an input unit by which information about a selected type of print medium is entered; and a print data generator configured to generate the print data representing images in the expanded area on the basis of information about the selected type of print medium, information about the expanded area, and the image data;

wherein the expanded area is divided, in order from the top, into an external front edge portion disposed in an area beyond the front edge of the print medium and configured such that formation of dots in this portion is assigned to the dot-forming elements disposed opposite the slot;

an internal front edge portion on the front-edge portion of the print medium and is configured such that formation of dots in this portion is assigned to the dot-forming elements disposed opposite the slot;

an intermediate portion of the print medium;

an internal rear edge portion on the rear-edge portion of the print medium and is configured such that formation of dots in this portion is assigned to the dot-forming elements disposed opposite the slot; and an external rear edge portion disposed in an area beyond the rear edge of the print medium and configured such that formation of dots in this portion is assigned to the dot-forming elements disposed opposite the slot; and the area size memory substantially contains the dimensions of the external front edge portion in the sub-scanning direction;

the dimensions of the internal front edge portion in the sub-scanning direction;

the dimensions of the internal rear edge portion in the sub-scanning direction; and the dimensions of the external rear edge portion in the sub-scanning direction.

18. A dot-recording control device for generating print data to be sent to a dot-recording unit for recording dots on a surface of a print medium with the aid of a dot-recording head provided with a plurality of dot-forming elements for ejecting ink droplets, wherein the dot-recording unit is configured to drive the dot-recording head and/or the print medium to perform main scanning, to drive at least some of the dot-forming elements to form dots, and to cause the print medium to perform sub-scanning by being driven across the main scanning direction in between the main scans, and comprises a platen configured to extend in the main scanning direction and to be disposed opposite the dot-forming elements at least along part of a main scan path, and having a slot configured to extend in the main scanning direction, a width of the slot in the sub-scanning direction corresponding to a specific sub-scanning range on a surface of the dot recording head including at least part of the plurality of dot-forming elements, the dot-recording control device comprises an image data generator configured to generate image data for the images recorded on the print medium;

an area size memory configured to store information about an expanded area in accordance with a type of print medium to be used in the dot recording, the expanded area extending lengthwise beyond at least front and rear edges of the print medium and representing a recording area in which images are to be recorded on the print medium;

an input unit by which information about a selected type of print medium is entered; and a print data generator configured to generate the print data representing images in the expanded area on the basis of information about the selected type of print medium, information about the expanded area, and the image data;

wherein the type of the print medium depends on slipperiness of the print medium, the dot-recording control device further comprising a user interface unit configured to display a selection screen that allows a user to select one of a plurality of preinstalled print modes on a display, and that allows the selection be entered; wherein the area size memory comprises, an expanded area memory containing, for each print mode, a number of raster lines constituting the expanded area; and wherein the print data generator generates the print data for recording dots with which images can be formed in the expanded area on the basis of the selected print mode, the number of raster lines stored in the expanded area memory, and the image data for the images to be recorded on the print medium.

19. A dot-recording control device as defined in claim 18, wherein the plurality of available print modes include print modes with mutually different sub-scan resolutions, the sub-scan resolution representing a recording density of raster lines in the sub-scanning direction; and the print data generator comprises a raster line number setter setting a number of raster lines constituting the expanded area in accordance with the selected print mode and the number of raster lines stored in the expanded area memory.

20. A dot-recording control device for generating print data to be sent to a dot-recording unit for recording dots on a surface of a print medium with the aid of a dot-recording head provided with a plurality of dot-forming elements for ejecting ink droplets, wherein the dot-recording unit is configured to drive the dot-recording head and/or the print medium to perform main scanning, to drive at least some of the dot-forming elements to form dots, and to cause the print medium to perform sub-scanning by being driven across the main scanning direction in between the main scans, and comprises a platen configured to extend in the main scanning direction and to be disposed opposite the dot-forming elements at least along part of a main scan path, and having a slot configured to extend in the main scanning direction, a width of the slot in the sub-scanning direction corresponding to a specific sub-scanning range on a surface of the dot recording head including at least part of the plurality of dot-forming elements, the dot-recording control device comprises an image data generator configured to generate image data for the images recorded on the print medium;

an area size memory configured to store information about an expanded area in accordance with a type of print medium to be used in the dot recording, the expanded area extending lengthwise beyond at least front and rear edges of the print medium and representing a recording area in which images are to be recorded on the print medium;

an input unit by which information about a selected type of print medium is entered;

a print data generator configured to generate the print data representing images in the expanded area on the basis of information about the selected type of print medium, information about the expanded area, and the image data;

a user interface unit configured to display a selection screen that allows a user to select one of a plurality of preinstalled print modes on a display, and that allows the selection be entered; wherein the area size memory comprises, an expanded area memory containing, for each print mode, a number of raster lines constituting the expanded area; and wherein the print data generator generates the print data for recording dots with which images can be formed in the expanded area on the basis of the selected print mode, the number of raster lines stored in the expanded area memory, and the image data for the images to be recorded on the print medium;

wherein the plurality of available print modes include print modes with mutually different sub-scan resolutions, the sub-scan resolution representing a recording density of raster lines in the sub-scanning direction;

wherein the print data generator comprises a raster line number setter setting a number of raster lines constituting the expanded area in accordance with the selected print mode and the number of raster lines stored in the expanded area memory; and wherein the expanded area is divided, in order from the top, into an external front edge portion disposed in an area beyond the front edge of the print medium and configured such that formation of dots in this portion is assigned to the dot-forming elements disposed opposite the slot;

an internal front edge portion on the front-edge portion of the print medium and configured such that formation of dots in this portion is assigned to the dot-forming elements disposed opposite the slot;

an intermediate portion of the print medium;

an internal rear edge portion on the rear-edge portion of the print medium and configured such that formation of dots in this portion is assigned to the dot-forming elements disposed opposite the slot; and an external rear edge portion disposed in an area beyond the rear edge of the print medium and configured such that formation of dots in this portion is assigned to the dot-forming elements disposed opposite the slot; and the expanded area memory contains, for each print mode:

the number of raster lines constituting the external front edge portion;

the number of raster lines constituting the internal front edge portion;

the number of raster lines constituting the internal rear edge portion; and the number of raster lines constituting the external rear edge portion, a number of raster lines for the external front edge portion is such that the dimensions of the external front edge portion remain the same in the sub-scanning direction with respect to different print modes having mutually different sub-scan resolutions, when the same type of print medium is used; and a number of raster lines for the external rear edge portion is such that the dimensions of the external rear edge portion remain the same in the sub-scanning direction with respect to different print modes having mutually different sub-scan resolutions, when the same type of print medium is used.

21. A dot-recording control device as defined in claim 20, wherein, a number of raster lines for the internal front edge portion is such that the dimensions of the internal front edge portion remain the same in the sub-scanning direction with respect to different print modes having mutually different sub-scan resolutions, when the same type of print medium is used; and a number of raster lines for the internal rear edge portion is such that the dimensions of the internal rear edge portion remain the same in the sub-scanning direction with respect to different print modes having mutually different sub-scan resolutions, when the same type of print medium is used.

22. A dot-recording control device for generating print data to be sent to a dot-recording unit for recording dots on a surface of a print medium with the aid of a dot-recording head provided with a plurality of dot-forming elements for ejecting ink droplets, wherein the dot-recording unit is configured to drive the dot-recording head and/or the print medium to perform main scanning, to drive at least some of the dot-forming elements to form dots, and to cause the print medium to perform sub-scanning by being driven across the main scanning direction in between the main scans, and comprises a platen configured to extend in the main scanning direction and to be disposed opposite the dot-forming elements at least along part of a main scan path, and having a slot configured to extend in the main scanning direction, a width of the slot in the sub-scanning direction corresponding to a specific sub-scanning range on a surface of the dot recording head including at least part of the plurality of dot-forming elements, the dot-recording control device comprises an image data generator configured to generate image data for the images recorded on the print medium;

an area size memory configured to store information about an expanded area in accordance with a type of print medium to be used in the dot recording, the expanded area extending lengthwise beyond at least front and rear edges of the print medium and representing a recording area in which images are to be recorded on the print medium;

an input unit by which information about a selected type of print medium is entered;

a print data generator configured to generate the print data representing images in the expanded area on the basis of information about the selected type of print medium, information about the expanded area, and the image data; and a user interface unit configured to display a selection screen that allows a user to select one of a plurality of preinstalled print modes on a display, and that allows the selection be entered;

wherein the area size memory comprises, an expanded area memory containing, for each print mode, a number of raster lines constituting the expanded area;

wherein the print data generator generates the print data for recording dots with which images can be formed in the expanded area on the basis of the selected print mode, the number of raster lines stored in the expanded area memory, and the image data for the images to be recorded on the print medium;

wherein the plurality of print modes include print modes having mutually different recording densities for the pixels in the main scanning direction;

wherein the platen further has a pair of lateral slots separated apart at a distance substantially equal to a width of the print medium, the lateral slots extending in a sub-scanning range in which ink droplets are ejected from the plurality of dot-forming elements, each lateral slot having side walls extending in the sub-scanning direction;

wherein the expanded area memory substantially contains numbers of pixels in the main scanning direction for the raster lines constituting the expanded area, the raster lines extending widthwise beyond left and right edges of the print medium but remains between outside edges of the pair of lateral slots, and wherein the print data generator comprises a raster line number setter setting the number of raster lines constituting the expanded area in accordance with the selected print mode and the number of raster lines stored in the expanded area memory.

23. A dot-recording device for recording ink dots on a surface of a print medium with the aid of a dot-recording head provided with a plurality of dot-forming elements for ejecting ink droplets, the dot-recording device comprising:

a main scanning unit configured to drive the dot-recording head and/or the print medium to perform main scanning;

a head driver configured to drive at least some of the dot-forming elements to form dots during the main scanning;

a platen configured to extend in the main scanning direction and to be disposed opposite the dot-forming elements at least along part of a main scan path;

a sub-scanning unit configured to move the print medium to perform sub-scanning in between the main scans; and a controller configured to control the dot-recording device, wherein the platen has a slot configured to extend in the main scanning direction, a width of the slot in the sub-scanning direction corresponding to a specific sub-scanning range on a surface of the dot recording head including at least part of the plurality of dot-forming elements; and the controller comprises a print data memory configured to store a print data for recording images in an expanded area that extends lengthwise beyond at least front and rear edges of the print medium, the print data being selected in accordance with the required type of print medium; and an edge printing unit configured to perform edge printing by ejecting ink droplets from at least some of the dot-forming elements disposed opposite the slot when images are printed at least in front- or rear-edge portions of the print medium on the basis of the print data;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

24. A dot-recording device as defined in claim 23, wherein the controller further comprises:

a front-edge positioning unit which selects the position of the print medium in the sub-scanning direction when ink droplets are ejected onto the front edge of the print medium, such that the print medium is supported on the platen, the front edge of the print medium is brought to a point above the slot, and the front edge of the print medium reaches a point located in the sub-scanning direction upstream of a dot-forming element at a downstream end in the sub-scanning direction; and a rear-edge positioning unit which selects the position of the print medium in the sub-scanning direction when ink droplets are ejected onto the rear edge of the print medium, such that the print medium is supported on the platen, the rear edge of the print medium is brought to a point above the slot, and the rear edge of the print medium reaches a point located in the sub-scanning direction downstream of a dot-forming element at an upstream end in the sub-scanning direction.

25. A dot-recording device for recording ink dots on a surface of a print medium with the aid of a dot-recording head provided with a plurality of dot-forming elements for ejecting ink droplets, the dot-recording device comprising:

a main scanning unit configured to drive the dot-recording head and/or the print medium to perform main scanning;

a head driver configured to drive at least some of the dot-forming elements to form dots during the main scanning;

a platen configured to extend in the main scanning direction and to be disposed opposite the dot-forming elements at least along part of a main scan path;

a sub-scanning unit configured to move the print medium to perform sub-scanning in between the main scans; and a controller configured to control the dot-recording device, wherein the platen has a slot configured to extend in the main scanning direction, a width of the slot in the sub-scanning direction corresponding to a specific sub-scanning range on a surface of the dot recording head including at least part of the plurality of dot-forming elements; and the controller comprises a print data memory configured to store a print data for recording images in an expanded area that extends lengthwise beyond at least front and rear edges of the print medium, the print data being selected in accordance with the required type of print medium; and an edge printing unit configured to perform edge printing by ejecting ink droplets from at least some of the dot-forming elements disposed opposite the slot when images are printed at least in front- or rear-edge portions of the print medium on the basis of the print data;

wherein the platen further has a pair of lateral slots separated apart at a distance substantially equal to a width of the print medium, the lateral slots extending in a sub-scanning range in which ink droplets are ejected from the plurality of dot-forming elements, wherein the dot-recording device further comprising:

a guide for positioning the print medium in the main scanning direction such that the print medium is supported on the platen, and the left and right edges of the print medium are brought to a point above the lateral slots; wherein the edge printing unit forms dots on the basis of image data representing an image extending outside the print medium beyond the left and right edges.

26. A dot-recording device for recording ink dots on a surface of a print medium with the aid of a dot-recording head provided with a plurality of dot-forming elements for ejecting ink droplets, the dot-recording device comprising:

a main scanning unit configured to drive the dot-recording head and/or the print medium to perform main scanning;

a head driver configured to drive at least some of the dot-forming elements to form dots during the main scanning;

a platen configured to extend in the main scanning direction and to be disposed opposite the dot-forming elements at least along part of a main scan path;

a sub-scanning unit configured to move the print medium to perform sub-scanning in between the main scans; and a controller configured to control the dot-recording device, wherein the platen has a slot configured to extend in the main scanning direction, a width of the slot in the sub-scanning direction corresponding to a specific sub-scanning range on a surface of the dot recording head including at least part of the plurality of dot-forming elements; and the controller comprises a print data memory configured to store a print data for recording images in an expanded area that extends lengthwise beyond at least front and rear edges of the print medium, the print data being selected in accordance with the required type of print medium; and an edge printing unit configured to perform edge printing by ejecting ink droplets from at least some of the dot-forming elements disposed opposite the slot when images are printed at least in front- or rear-edge portions of the print medium on the basis of the print data;

wherein the type of the print medium depends on slipperiness of the print medium, and wherein the controller further comprises:

a print data memory for storing the print data in accordance with the specific print mode.

27. A dot-recording device as defined in claim 26, wherein the edge printing unit prints images using solely the dot-forming elements disposed opposite the slot.

28. A dot-recording device as defined in claim 26, wherein the edge printing unit further comprises:

a front-edge positioning unit that positions, when ink droplets are ejected onto the front edge of the print medium, the print medium in the sub-scanning direction such that the print medium is supported on the platen, the front edge of the print medium is brought to a point above the slot, and the front edge of the print medium reaches a point located in the sub-scanning direction upstream of a dot-forming element at a downstream end in the sub-scanning direction; and a rear edge positioning unit that positions, when ink droplets are ejected onto the rear edge of the print medium, the print medium in the sub-scanning direction such that the print medium is supported on the platen, the rear edge of the print medium is brought to a point above the slot, and the rear edge of the print medium reaches a point located in the sub-scanning direction downstream of a dot-forming element at an upstream end in the sub-scanning direction.

29. A dot-recording device as defined in claim 26, further comprising a guide for positioning the print medium in the main scanning direction such that the print medium is supported on the platen, and the left and right edges of the print medium are brought to a point above the lateral slots; and the controller further comprises a side edge printing unit for forming dots on the basis of image data representing an image extending outside the print medium beyond the left and right edges.

30. A computer program product for recording ink dots on a surface of a print medium using a computer, the computer equipped with a dot-recording device for recording ink dots on a surface of a print medium with the aid of a dot-recording head provided with a plurality of dot-forming elements for ejecting ink droplets, wherein the dot-recording device comprises a platen configured to extend in the main scanning direction and to be disposed opposite the dot-forming elements at least along part of a main scan path, the platen being configured to have a slot configured to extend in the main scanning direction, a width of the slot in the sub-scanning direction corresponding to a specific sub-scanning range on a surface of the dot recording head including at least part of the plurality of dot-forming elements; the computer program product comprising:

a computer readable medium; and a computer program stored on the computer readable medium, the computer program comprising:

a first program for causing the computer to prepare print data for recording images in a expanded area, the print data representing a recording area in which images are to be recorded on the print medium, and being set in accordance with a type of print medium to be used in the dot recording, the expanded area extending lengthwise beyond at least front and rear edges of the print medium; and a second program for causing the computer to eject ink droplets from at least some of the dot-forming elements disposed opposite the slot when images are printed at least in front- or rear-edge portions of the print medium on the basis of the print data;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

31. A computer program product as defined in claim 30, wherein a relatively large expanded area in the sub-scanning direction is set to a print medium that is included in a type of print medium with a specific slipperiness and a relatively large dimension in the sub-scanning direction, and a relatively small expanded area in the sub-scanning direction is set to a print medium that is included in the type of print medium with the specific slipperiness and a relatively small dimension in the sub-scanning direction.

32. A computer program product as defined in claim 30, wherein the first program comprises a program for preparing the print data containing information about recording condition of dots at pixels inside the expanded area.

33. A computer program product for recording ink dots on a surface of a print medium using a computer, the computer equipped with a dot-recording device for recording ink dots on a surface of a print medium with the aid of a dot-recording head provided with a plurality of dot-forming elements for ejecting ink droplets, wherein the dot-recording device comprises a platen configured to extend in the main scanning direction and to be disposed opposite the dot-forming elements at least along part of a main scan path, the platen being configured to have a slot configured to extend in the main scanning direction, a width of the slot in the sub-scanning direction corresponding to a specific sub-scanning range on a surface of the dot recording head including at least part of the plurality of dot-forming elements; the computer program product comprising:

a computer readable medium; and a computer program stored on the computer readable medium, the computer program comprising:

a first program for causing the computer to prepare print data for recording images in a expanded area, the print data representing a recording area in which images are to be recorded on the print medium, and being set in accordance with a type of print medium to be used in the dot recording, the expanded area extending lengthwise beyond at least front and rear edges of the print medium; and a second program for causing the computer to eject ink droplets from at least some of the dot-forming elements disposed opposite the slot when images are printed at least in front- or rear-edge portions of the print medium on the basis of the print data;

wherein the platen further has a pair of lateral slots separated apart at a distance substantially equal to a width of the print medium the lateral slots extending in a sub-scanning range in which ink droplets are ejected from the plurality of dot-forming elements, wherein the first program comprises a program for preparing the print data for recording images in an expanded area, the expanded area extending widthwise beyond left and right edges of the print medium but remaining between farthermost side walls of the pair of lateral slots.

34. A computer program product for recording ink dots on a surface of a print medium using a computer, the computer equipped with a dot-recording device for recording ink dots on a surface of a print medium with the aid of a dot-recording head provided with a plurality of dot-forming elements for ejecting ink droplets, wherein the dot-recording device comprises a platen configured to extend in the main scanning direction and to be disposed opposite the dot-forming elements at least along part of a main scan path, the platen being configured to have a slot configured to extend in the main scanning direction, a width of the slot in the sub-scanning direction corresponding to a specific sub-scanning range on a surface of the dot recording head including at least part of the plurality of dot-forming elements; the computer program product comprising:

a computer readable medium; and a computer program stored on the computer readable medium, the computer program comprising:

a first program for causing the computer to prepare print data for recording images in a expanded area, the print data representing a recording area in which images are to be recorded on the print medium, and being set in accordance with a type of print medium to be used in the dot recording, the expanded area extending lengthwise beyond at least front and rear edges of the print medium; and a second pro gram for causing the computer to eject ink droplets from at least some of the dot-forming elements disposed opposite the slot when images are printed at least in front- or rear-edge portions of the print medium on the basis of the print data;

wherein the type of the print medium depends on slipperiness of the print medium and wherein the first program comprises:

a user interface program which displays a selection screen that allows the user to select one of a plurality of preinstalled print modes on a display, and that allows the selection be entered; wherein the area size memory comprises, and a print data generating program which generates the print data in accordance with he selected print mode.

35. A computer program product as defined in claim 34, wherein the user interface program displays the selection screen that allows the user to select one of the available print modes with mutually different sub-scan resolutions, the sub-scan resolution representing a recording density of raster lines in the sub-scanning direction; and the print data generating program sets a number of raster lines constituting the expanded area in accordance with the selected print mode and the number of raster lines stored in the expanded area memory.

36. A computer program product for recording ink dots on a surface of a print medium using a computer, the computer equipped with a dot-recording device for recording ink dots on a surface of a print medium with the aid of a dot-recording head provided with a plurality of dot-forming elements for ejecting ink droplets, wherein the dot-recording device comprises a platen configured to extend in the main scanning direction and to be disposed opposite the dot-forming elements at least along part of a main scan path, the platen being configured to have a slot configured to extend in the main scanning direction, a width of the slot in the sub-scanning direction corresponding to a specific sub-scanning range on a surface of the dot recording head including at least part of the plurality of dot-forming elements; the computer program product comprising:

a computer readable medium; and a computer program stored on the computer readable medium, the computer program comprising:

a first program for causing the computer to prepare print data for recording images in a expanded area, the print data representing a recording area in which images are to be recorded on the print medium, and being set in accordance with a type of print medium to be used in the dot recording, the expanded area extending lengthwise beyond at least front and rear edges of the print medium; and a second program for causing the computer to eject ink droplets from at least some of the dot-forming elements disposed opposite the slot when images are printed at least in front- or rear-edge portions of the print medium on the basis of the print data;

wherein the first program comprises:

a user interface program which displays a selection screen that allows the user to select one of a plurality of preinstalled print modes on a display, and that allows the selection be entered; wherein the area size memory comprises, and a print data generating program which generates the print data in accordance with he selected print mode;

wherein the user interface program displays the selection screen that allows the user to select one of the available print modes with mutually different sub-scan resolutions, the sub-scan resolution representing a recording density of raster lines in the sub-scanning direction;

wherein the print data generating program sets a number of raster lines constituting the expanded area in accordance with the selected print mode and the number of raster lines stored in the expanded area memory; and wherein the expanded area is divided, in order from the top, into an external front edge portion disposed in an area beyond the front edge of the print medium and configured such that formation of dots in this portion is assigned to the dot-forming elements disposed opposite the slot;

an internal front edge portion on the front-edge portion of the print medium and configured such that formation of dots in this portion is assigned to the dot-forming elements disposed opposite the slot;

an intermediate portion of the print medium;

an internal rear edge portion on the rear-edge portion of the print medium and configured such that formation of dots in this portion is assigned to the dot-forming elements disposed opposite the slot; and an external rear edge portion disposed in an area beyond the rear edge of the print medium and configured such that formation of dots in this portion is assigned to the dot-forming elements disposed opposite the slot; and the print data generating program sets:

the number of raster lines constituting the external front edge portion;

the number of raster lines constituting the internal front edge portion;

the number of raster lines constituting the internal rear edge portion; and the number of raster lines constituting the external rear edge portion, a number of raster lines for the external front edge portion being such that the dimensions of the external front edge portion remain the same in the sub-scanning direction with respect to different print modes having mutually different sub-scan resolutions, when the same type of print medium is used; and a number of raster lines for the external rear edge portion being such that the dimensions of the external rear edge portion remain the same in the sub-scanning direction with respect to different print modes having mutually different sub-scan resolutions, when the same type of print medium is used.

37. A computer program product as defined in claim 36, wherein, the print data generating program sets:

a number of raster lines for the internal front edge portion such that the dimensions of the internal front edge portion remain the same in the sub-scanning direction with respect to different print modes having mutually different sub-scan resolutions, when the same type of print medium is used; and a number of raster lines for the internal rear edge portion such that the dimensions of the internal rear edge portion remain the same in the sub-scanning direction with respect to different print modes having mutually different sub-scan resolutions, when the same type of print medium is used.

38. A computer program product for recording ink dots on a surface of a print medium using a computer, the computer equipped with a dot-recording device for recording ink dots on a surface of a print medium with the aid of a dot-recording head provided with a plurality of dot-forming elements for ejecting ink droplets, wherein the dot-recording device comprises a platen configured to extend in the main scanning direction and to be disposed opposite the dot-forming elements at least along part of a main scan path, the platen being configured to have a slot configured to extend in the main scanning direction, a width of the slot in the sub-scanning direction corresponding to a specific sub-scanning range on a surface of the dot recording head including at least part of the plurality of dot-forming elements; the computer program product comprising:

a computer readable medium; and a computer program stored on the computer readable medium, the computer program comprising:

a first program for causing the computer to prepare print data for recording images in a expanded area, the print data representing a recording area in which images are to be recorded on the print medium, and being set in accordance with a type of print medium to be used in the dot recording, the expanded area extending lengthwise beyond at least front and rear edges of the print medium; and a second program for causing the computer to eject ink droplets from at least some of the dot-forming elements disposed opposite the slot when images are printed at least in front- or rear-edge portions of the print medium on the basis of the print data;

wherein the first program comprises:

a user interface program which displays a selection screen that allows the user to select one of a plurality of preinstalled print modes on a display, and that allows the selection be entered; wherein the area size memory comprises, and a print data generating program which generates the print data in accordance with he selected print mode;

wherein the platen further has a pair of lateral slots separated apart at a distance substantially equal to a width of the print medium, the lateral slots extending in a sub-scanning range in which ink droplets are ejected from the plurality of dot-forming elements;

wherein the user interface program displays the selection screen that allows the user to select one of the print modes with mutually different recording densities for the raster lines in the sub-scanning direction; and wherein the print data generating program sets numbers of pixels in the main scanning direction for the raster lines constituting the expanded area such that the raster lines extending widthwise beyond left and right edges of the print medium but remains between outside edges of the pair of lateral slots.

39. A dot-recording method using a dot-recording device for recording ink dots on a surface of a print medium, the dot-recording device including a dot-recording head having a plurality of dot-forming elements for ejecting ink droplets, the dot-recording method containing forming dots by driving at least part of the plurality of dot-forming elements while performing main scan, and performing sub-scan between the main scans, the main scan being a procedure of moving the dot-recording head and/or the print medium, the sub-scan being a procedure of moving the print medium in a direction crossing to a direction of the main scan, the print medium containing a usable area which is defined by a closed perforated line in the entire area of the print medium, the dot recording method further comprises the steps of:

(A) setting an expanded area for image recording in accordance with a type of print medium, the expanded area extending beyond ends of the usable area along the entire perimeter thereof;

(B) preparing print data for recording images in the expanded area; and (C) recording dots by ejecting ink droplets from at least some of the dot-forming elements to the expanded area;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

40. A dot-recording method as defined in claim 39, further comprising the step of:

(E) selecting a printing mode from a plurality of printing modes; and wherein the step (B) comprises the step of:

(B1) preparing the print data in accordance with the selected printing mode.

41. A dot-recording control device for generating a print data for a dot recording unit for recording ink dots on a surface of a print medium with the aid of a dot-recording head provided with a plurality of dot-forming elements for ejecting ink droplets, wherein the dot-recording unit is configured to form dots by driving at least part of the plurality of dot-forming elements while performing main scan, and to perform sub-scan between the main scans, the main scan being a procedure of moving the dot-recording head and/or the print medium, the sub-scan being a procedure of moving the print medium in a direction crossing to a direction of the main scan, the print medium containing a usable area which is defined by a closed perforated line in the entire area of the print medium, the dot-recording control device comprising:

an image data generator configured to generate image data for an image to be recorded on the print medium;

an area size memory configured to store information about an expanded area to be used in dot recording in accordance with a type of print medium, the expanded area extending beyond ends of the usable area along the entire perimeter thereof;

an input unit by which information about a type of print medium is entered; and a print data generator configured to generate the print data for recording dots for printing images in the expanded area on the basis of information about the type of print medium entered via the input unit, information about the expanded area, and the image data;

wherein a relatively large expanded area in the sub-scanning direction is set to a print medium that is included in relatively more slippery type of print medium with a specific dimension in the sub-scanning direction, and a relatively small expanded area in the sub-scanning direction is set to a print medium that is included in relatively less slippery type of print medium with the specific dimension.

42. A dot-recording control device as defined in claim 41, further comprising a user interface unit configured to display a selection screen that allows a user to select one of a plurality of preinstalled print modes on a display, and that allows the selection be entered; wherein the area size memory comprises an expanded area memory containing, for each print mode, a number of raster lines constituting the expanded area extending lengthwise beyond at least front and rear edges of the usable area; and wherein the print data generator generates the print data on the basis of the selected print mode, the number of raster lines stored in the expanded area memory, and the image data.

* * * * *

UNITED STATES PATENT AND TRADEMARK OFFICE

CERTIFICATE OF CORRECTION

PATENT NO. : 6,746,101 B2
DATED : June 8, 2004
INVENTOR(S) : Koichi Otsuki

It is certified that error appears in the above-identified patent and that said Letters Patent is hereby corrected as shown below:

Column 36,
Line 52, change "B2" to -- B1 --.

Signed and Sealed this

Twenty-eighth Day of December, 2004

JON W. DUDAS
*Director of the United States Patent and Trademark Office*